US006661442B2

(12) United States Patent
Koga et al.

(10) Patent No.: US 6,661,442 B2
(45) **Date of Patent: *Dec. 9, 2003**

(54) IMAGE FORMING APPARATUS HAVING WRITING ELECTRODES FOR FORMING AN ELECTROSTATIC LATENT IMAGE

(75) Inventors: Yoshiro Koga, Nagano-Ken (JP); Shinichi Kamoshida, Nagano-Ken (JP); Kaneo Yoda, Nagano-Ken (JP); Nobumasa Abe, Nagano-Ken (JP); Yujiro Nomura, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/315,063

(22) Filed: Dec. 10, 2002

(65) Prior Publication Data

US 2003/0117478 A1 Jun. 26, 2003

Related U.S. Application Data

(63) Continuation of application No. 09/966,599, filed on Oct. 1, 2001, now Pat. No. 6,532,031.

(30) Foreign Application Priority Data

| | | |
|---|---|---|
| Sep. 29, 2000 | (JP) | 2000-300646 |
| Sep. 29, 2000 | (JP) | 2000-300647 |
| Sep. 29, 2000 | (JP) | 2000-300700 |
| Oct. 6, 2000 | (JP) | 2000-307682 |
| Aug. 8, 2001 | (JP) | 2001-240324 |

(51) Int. Cl.[7] ..... B41J 2/41

(52) U.S. Cl. ..... 347/141; 347/147

(58) Field of Search ..... 347/141–150

(56) References Cited

U.S. PATENT DOCUMENTS

| | | | | |
|---|---|---|---|---|
| 3,624,661 A | | 11/1971 | Shebanow et al. | |
| 4,233,611 A | | 11/1980 | Nakano et al. | |
| 4,567,495 A | * | 1/1986 | Yuasa et al. | 347/149 |
| 4,607,269 A | | 8/1986 | Playe | |
| 4,920,356 A | * | 4/1990 | Goebel et al. | 347/149 |
| 5,812,170 A | | 9/1998 | Kuehnle et al. | |
| 5,842,087 A | | 11/1998 | Matsushita et al. | |
| 6,362,845 B1 | | 3/2002 | Genovese | |
| 6,532,031 B2 | * | 3/2003 | Koga et al. | 347/141 |

FOREIGN PATENT DOCUMENTS

| | | |
|---|---|---|
| JP | 63-45104 B2 | 9/1988 |
| JP | 6-166206 A | 6/1994 |

* cited by examiner

*Primary Examiner*—Joan Pendegrass
(74) *Attorney, Agent, or Firm*—Sughrue Mion, PLLC

(57) ABSTRACT

In an image forming apparatus, a resistant layer of each writing electrode is formed substantially in a semi-circular convex shape projecting upwardly. The top of the resistant layer is a spherical surface so that the resistant layer is in point contact with the charged layer of the latent image carrier. Because of point contacts, foreign matters adhering to the surface of the latent image carrier are easily allowed to pass, thereby preventing the occurrence of filming on the surface of the latent image carrier.

5 Claims, 22 Drawing Sheets

(a)

(b)

(c)

(a)

(b)

(c)

(b)

(a)

(c)

(d)

(a)

(b)

(c)

IMAGE FORMING APPARATUS HAVING WRITING ELECTRODES FOR FORMING AN ELECTROSTATIC LATENT IMAGE

This is a continuation of Application No. 09/966,599 filed Oct. 1, 2001 now U.S. Pat No. 6,532,031; the disclosure of which is incorporated herein by reference.

BACKGROUND OF THE INVENTION

The present invention relates to an image forming apparatus which forms an electrostatic latent image on a latent image carrier by using writing electrodes of a writing device, thereby forming the image.

In a conventional image forming apparatus such as an electrostatic copying machine and a printer, the surface of a photoreceptor (photosensitive member) is uniformly charged by a charging device and the charged surface is then exposed to light from an exposure device such as laser beam or LED light, whereby a latent image is written on the surface of the photoreceptor. Then, the latent image on the surface of the photoreceptor is developed by a developing device to form a developing powder image on the surface of the photoreceptor. The developing powder image is transferred to a receiving medium such as a paper, thereby forming the image.

In such conventional image forming apparatus, the exposure device as a writing device for electrostatic latent image comprises a laser beam generating device or a LED light generating device. Therefore, the entire image forming apparatus should be large and complex.

Therefore, an image forming apparatus has been proposed in Japanese Patent Publication No. S63-45104 (hereinafter, '104B publication) which employs electrodes, as a writing device for forming an electrostatic latent image, to write an electrostatic latent image on a surface of a latent image carrier without using laser beams and LED lights.

The image forming apparatus disclosed in the '104B publication is provided with a multistylus having a large number of needle electrodes. The needle electrodes are just arranged in contact with an inorganic glass layer on the surface of the latent image carrier. In accordance with an input signal for image information, voltages are selectively applied to corresponding ones of the needle electrodes of the multistylus, whereby the electrostatic latent image can be formed on the latent image carrier. Since the image forming apparatus according to the '104B publication does not use an exposure device conventionally used as a writing device, the invention of this publication can provide an image forming apparatus which is relatively small in size and relatively simple in structure.

In addition, an image forming apparatus has been proposed in Japanese Unexamined Patent Publication No. H06-166206 (hereinafter, '206A publication), comprising ion control electrodes which are disposed on a front end portion of an insulating substrate and are arranged in non-contact with a latent image carrier, wherein the ion control electrodes control ions generated by a corona discharger so as to write an electrostatic latent image on the latent image carrier. Since the image forming apparatus according to the '206A publication also does not use an exposure device as a writing device, the invention of this publication can provide an image forming apparatus which is relatively small in size and relatively simple in structure.

However, in the image forming apparatus according to the '104B publication, the large number of needle electrodes of the multistylus are just arranged in contact with the inorganic glass layer on the surface of the latent image carrier. It is difficult to keep the stable contact between the needle electrodes and the inorganic glass layer on the surface of the latent image carrier. Accordingly, it is difficult to stably apply charge to the surface of the latent image carrier. This means that it is hard to obtain a high quality image.

Moreover, it is unavoidable to employ an inorganic glass layer on the surface of the latent image carrier for protecting the surface of the latent image carrier from damage due to contacts of a large number of the needle electrodes. This makes the structure of the latent image carrier more complex. In addition, since the inorganic glass layer has quite well physical adsorbed water characteristic, moisture is easily adsorbed by the surface of the inorganic glass layer. Due to the moisture, the electrical conductivity of the glass surface is increased so that electrostatic charge on the latent image carrier should leak. Therefore, the image forming apparatus should be provided with a means for drying the surface of the latent image carrier with adsorbed moisture in order to prevent the apparatus from being affected by absorbed water. This not only makes the apparatus larger but also increases the number of parts, leading to problems of making the structure further complex and increasing the cost.

Since the large number of needle electrodes discharge, the apparatus has another problem that there is a high possibility of generation of ozone ($O_3$). The presence of ozone may not only produce rusts on parts in the apparatus but also melt resin parts because ozone reacts with $NO_x$ to generate nitrous acid ($HNO_3$). Again ozone may give an offensive smell. Therefore, the image forming apparatus should be provided with an ventilation system including a duct and an ozone filter which sufficiently exhausts ozone from the inside of the apparatus. This also not only makes the apparatus larger but also increases the number of parts, leading to problems of making the structure further complex and increasing the cost.

On the other hand, in the image forming apparatus according to the '206A publication, ions produced by the corona discharger are controlled by the ion control electrodes. This means that the apparatus is structured not to directly inject electric charge to the latent image carrier. The invention of the '206A publication has problems of not only making the image forming apparatus larger and but also making the structure complex. Since the application of charge is conducted by ions, it is difficult to stably write a latent image on the latent image carrier.

Further, since the generation of ions essentially generates ozone, there are problems similar to those described with regard to the image forming apparatus according to '104B publication.

SUMMARY OF THE INVENTION

It is an object of the present invention to provide an image forming apparatus capable of more stably writing an electrostatic latent image and yet achieving reduction in size and reduction in the number of parts thereof so as to have more simple and low-priced structure.

It is another object of the present invention to provide an image forming apparatus capable of further preventing generation of ozone.

In order to achieve these objects, the present invention provides an image forming apparatus which comprises at least: a latent image carrier on which an electrostatic latent image is formed, a writing device for writing said electrostatic latent image on said latent image carrier, and a developing device for developing said electrostatic latent image on the latent image carrier, wherein said electrostatic latent image, written on said latent image carrier by said writing device, is developed by said developing device, thereby forming an image, and is characterized in that said writing device has writing electrodes for writing said electrostatic latent image on said latent image carrier and a flexible substrate for supporting said writing electrodes, wherein said writing electrodes are in contact with said latent image carrier with a small pressing force due to elasticity of said flexible substrate, and that each of said writing electrodes comprises a convexity projecting from said substrate toward said latent image carrier.

The present invention is characterized in that said each writing electrode is formed in any one of configurations including a portion of sphere, a circular column, a cone, a truncated cone, an elliptic column (column of which cross section is elliptic), an elliptic cone (cone of which cross section is elliptic), a truncated elliptic cone (truncated cone of which cross section is elliptic), an oval column (column of which cross section is oval), an oval cone (cone of which cross section is oval), a truncated oval cone (truncated cone of which cross section is oval), a triangle column, a triangle pyramid, a truncated triangle pyramid, a square column, a square pyramid, a truncated square pyramid, a polygonal column having five corners or more, a polygonal pyramid having five corners or more, and a truncated polygonal pyramid having five corners or more.

The present invention is further characterized in that at least said each writing electrode is coated with a protective layer.

The present invention is still characterized in that at least a portion of said each writing electrode confronting said latent image carrier is made of a material easily to wear.

The present invention is still further characterized in that said developing device is a developing device for developing said electrostatic latent image with developing powder consisting of a single component; by further comprising a transferring device for transferring a developing powder image on said latent image carrier, developed by said developing device, to a receiving medium; and in that residual developing powder left on said latent image carrier after transfer is adapted to be charged to have the same polarity as the original polarity of said developing powder consisting of a single component.

Further, the present invention is characterized in that a large number of microscopic particles are interposed at least between said writing electrodes and said latent image carrier to allow free rolling of said microscopic particles, wherein said microscopic particles are adapted to be charged at least to have the same polarity as the original polarity of said developing powder before developing of said electrostatic latent image.

Furthermore, the present invention is characterized by further comprising a charge control device for making said latent image carrier into a uniformly charged state, wherein residual developing powder left on said latent image carrier after transfer is adapted to be charged to have the same polarity as the original polarity of said developing powder consisting of a single component at the same time when said charge control device makes said latent image carrier into the uniformly charged state.

Moreover, the present invention is characterized in that said developing is reverse developing.

In the image forming apparatus of the present invention having the aforementioned structure, a convexity of each writing electrode is in contact with a latent image carrier so that the surface of the writing electrode is not entirely in contact with the latent image carrier, thereby allowing easy passing of foreign matters adhering to the surface of the latent image carrier and thus preventing the filming of the surface of the latent image carrier.

In addition, the writing electrodes are supported by a flexible substrate, thereby stabilizing the positions of the writing electrodes relative to the latent image carrier and thus stably and reliably conducting the application or removal of charge by the writing electrodes relative to the latent image carrier. Therefore, stable writing of an electrostatic latent image onto the latent image carrier is achieved, thus reliably obtaining a high quality image with high precision.

Since the writing electrodes can be securely kept in contact with the latent image carrier with a small pressing force by the flexible substrate, the gap (space) between the writing electrodes and the latent image carrier can be eliminated. No gap practically reduces the possibility that air existing in the gap is undesirably ionized, thereby further reducing the generation of ozone and enabling the formation of an electrostatic latent image with low potential. In addition, the latent image carrier can be prevented from being damaged by the writing electrodes, thus improving the durability of the latent image carrier.

Further, since the writing device employs only the writing electrodes without using a laser beam generating device or a LED light generating device which is large in size as conventionally used, the apparatus size can be reduced and the number of parts can also be reduced, thereby obtaining an image forming apparatus which is simple and low-price.

In the present invention, since the convexity of the writing electrode is allowed to be formed in various configurations, the writing electrode is flexible to be employed in various types of image forming apparatus. In particular, when the convexity of the writing electrode is formed in a portion of sphere, a cone, an elliptic cone, an oval cone, a triangle pyramid, a square pyramid, or a polygonal pyramid having five corners or more, the writing electrode and the latent image carrier are in point contact, thereby further securely allowing foreign matters adhering to the surface of the latent image carrier to pass through. When the convexity of the writing electrode is formed in a circular column, a truncated cone, an elliptic column, a truncated elliptic cone, an oval column, a truncated oval cone, a triangle column, a truncated triangle pyramid, a square column of which cross section is a parallelogram or a trapezoid, a truncated square pyramid of which cross section is a parallelogram or a trapezoid, a polygonal column (having five corners or more), and a truncated polygonal pyramid (having five corners or more), the writing electrode has side faces inclined against the feeding direction, whereby foreign matters adhering to the surface of the latent image carrier can easily pass through because the foreign matters easily slide along the inclined faces.

In the present invention, at least the writing electrodes are coated with the protective layers. The protective layers prevent wear of the writing electrodes and prevent foreign matters from adhering to the writing electrodes.

In the present invention, since the portion of the writing electrode confronting the latent image carrier is made of material easily to wear, the surface of the writing electrode should wear due to the contact relative to the latent image carrier so as to have a fresh surface so that the surface of the writing electrode can be kept fresh, thus preventing the filming of the writing electrode.

In the present invention, residual developing powder which is left on the latent image carrier after the transfer is charged to have the same polarity as the original polarity of the developing powder consisting of a single component. Therefore, the residual developing powder, placed on non-image portions of the latent image carrier and charged as mentioned above, can be moved to a developing roller during the developing, while the residual developing powder, placed on image portions of the latent image carrier and charge as mentioned above, still remains on the latent image carrier as developing powder for subsequent developing . That is, this apparatus can form an image in the cleaner-less cleaning method in which the developing of a latent image and the cleaning of the latent image carrier can be simultaneously conducted.

In the present invention, employment of the writing device achieves reduction in size and simplification of the structure of the image forming apparatus. In addition, since it is a cleaner-less image forming apparatus without a cleaning device, further simple structure can be achieved.

In the present invention, a large number of microscopic particles are interposed at least between the writing electrodes and the latent image carrier. With the aid of the microscopic particles, foreign matters adhering to the surface of the latent image carrier can easily pass through, thus preventing the filming on the surface of the latent image carrier and on the surfaces of the writing electrodes. In addition, Free rolling of the microscopic particles reduces the friction between the writing electrodes and the latent image carrier, leading to reduction in torque for rotating the latent image carrier.

Since the charge of the microscopic particles is adapted to be charged to have the same polarity as the original polarity of the developing power, consisting of a single component, of the developing device, the residual developing powder on non-image portions of the latent image carrier can be further effectively removed or collected by the microscopic particles, placed on the non-image portions of the latent image carrier and charged as mentioned above. Interposing the microscopic particles between the writing electrodes and the latent image carrier enables to eliminate the necessity of the charge control device, thereby further simplifying the structure of the image forming apparatus without cleaning device.

In the present invention, since residual developing powder which is left on the latent image carrier after the transfer is charged to have the same polarity as the original polarity thereof at the same time when the latent image carrier is uniformly charged by the charge control device, application of charge to the residual developing powder can be easily conducted.

In the present invention, the developing is conducted by the reverse developing method. In this reverse developing method, the residual developing powder can be uniformed to have the same polarity of the developing powder during the process of uniformly charging the latent image carrier, thereby further easily and effectively conducting the cleaning at the same time of developing.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

The embodiments of the present invention will be described hereinafter with reference to the drawings.

Figure 1:
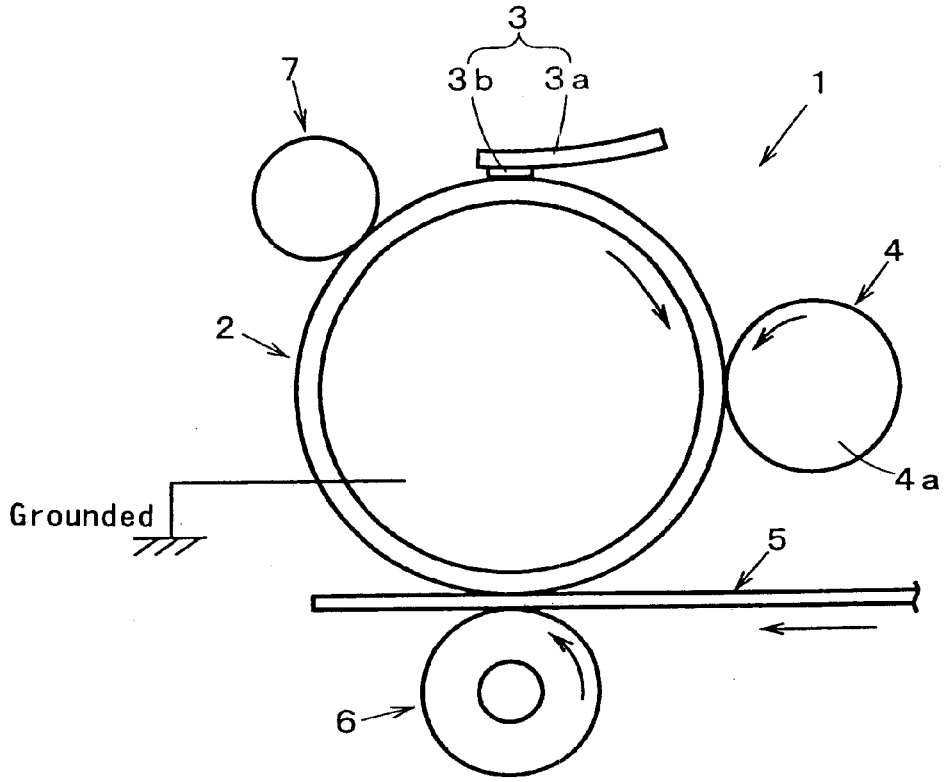
FIG. 1 is a schematic illustration of the basic structure of an image forming apparatus in accordance with the present invention.

FIG. 1 is a schematic illustration of the basic structure of an image forming apparatus in accordance with the present invention.

As shown in FIG. 1, an image forming apparatus 1 according to the present invention comprises, at least, a latent image carrier 2 on which an electrostatic latent image is formed, a writing device 3 (hereinafter, sometimes referred to as "writing head") which is arranged in contact with the latent image carrier 2 to write the electrostatic latent image on the latent image carrier 2, a developing device 4 which develops the electrostatic latent image on the latent image carrier 2 with developing powder carried and conveyed by a developing powder carrier 4*a* (developing roller), a transferring device 6 which transfers a developing powder image on the latent image carrier 2, developed by the developing device 4, to a receiving medium 5 such as a paper, and a charge control device 7 which makes the surface of the latent image carrier 2 into the uniformly charged state by removing any residual charge from the latent image carrier 2 after the transfer of the latent image or by charging (i.e. applying charge to) the latent image carrier 2 after the transfer of the electrostatic latent image.

Though the following description will be made assuming that the latent image carrier 2 is grounded, this is for the purpose of facilitating the description only and not of limitation. That is, the latent image carrier 2 may not be grounded.

The writing head 3 comprises a flexible substrate 3*a*, having high insulation property and being relatively soft and elastic, such as a FPC (Flexible Print Circuit: hereinafter, referred to as "FPC") or a PET (polyethylene terephthalate: hereinafter, referred to as "PET"), and writing electrodes 3*b* which are supported by the substrate 3*a* and which are pressed lightly against the latent image carrier 2 with weak elastic restoring force created by deflection of the substrate 3*a* so that the writing electrodes 3*b* are in contact with the latent image carrier 2 so as to write the electrostatic latent image.

In the image forming apparatus 1 having a structure as mentioned above, after the surface of the latent image carrier 2 is made into the uniformly charged state by the charge control device 7, an electrostatic latent image is written on the uniformly charged surface of the latent image carrier 2 by the writing head 3 which is in contact with the latent image carrier 2. Then, the electrostatic latent image on the latent image carrier 2 is developed with developing powder of the developing device 4 to form a developing powder image and the developing powder image is transferred to the receiving medium 5 by the transferring device 6. It should be noted that the uniformly charged state includes a state where there is neither positive (+) charge nor negative (−) charge i.e. no charge is uniformly applied to the latent image carrier 2 by removing charge from the latent image carrier 2.

Figure 2:
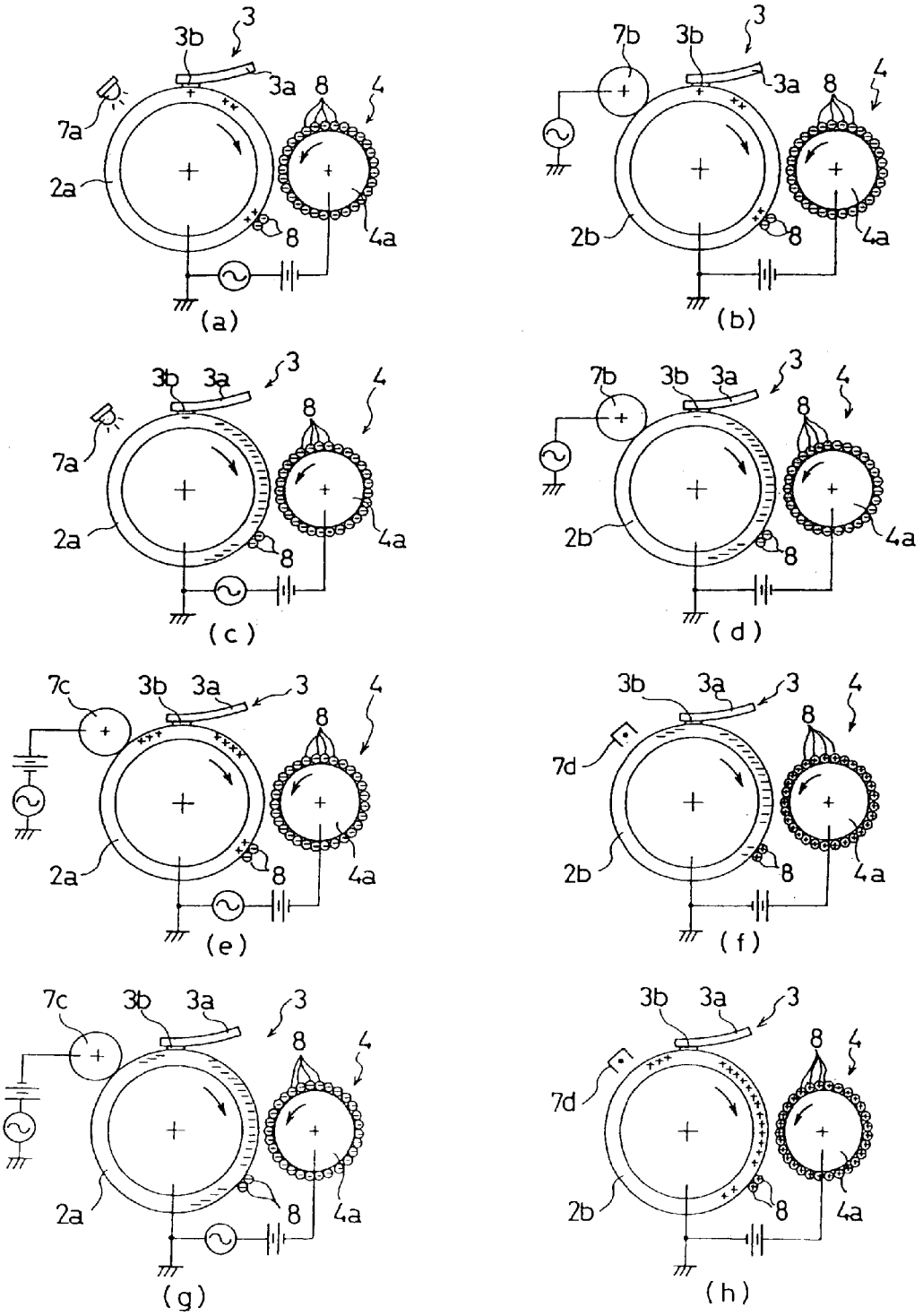
FIG. 2, parts (a)–(h), are views each illustrating an example of the basic process of forming an image in the image forming apparatus of the present invention.

FIGS. 2(*a*)–2(*h*) are views each illustrating an example of the basic process of forming an image in the image forming apparatus 1 of the present invention.

As the basic process of forming an image in the image forming apparatus 1 of the present invention, there are four types as follows: (1) making uniformly charged state by removal of charge—writing by contact application of charge—normal developing; (2) making uniformly charged state by removal of charge—writing by contact application of charge reversal developing; (3) making uniformly charged state by application of charge—writing by contact removal of charge—normal developing; and (4) making uniformly charged state by application of charge—writing by contact removal of charge—reversal developing.

(1) Making Uniformly Charged State by Removal of Charge—Writing by Contact Application of Charge—Normal Developing A process illustrated in FIG. 2(*a*) is an example of this image forming process. As shown in FIG. 2(*a*), in this example, a photoreceptor 2*a* is employed as the latent image carrier 2 and a charge removing lump 7*a* is employed as the charge control device 7. The electrodes 3*b* of the writing device 3 are in contact with the photoreceptor 2*a* so that positive (+) charge is mainly transferred (that is, injected) from the writing electrodes 3*b* to image portions of the photoreceptor 2*a*, whereby the image portions of the photoreceptor 2*a* are positively (+) charged. In this way, an electrostatic latent image is written on the photoreceptor 2*a*. In addition, a bias voltage composed of an alternating current superimposed on a direct current of a negative (−) polarity is applied to the developing powder carrier 4*a* such as an image developing roll of the developing device 4, as in conventional ones. Accordingly, the developing powder carrier 4*a* conveys negatively (−) charged developing powder 8 to the photoreceptor 2*a*. It should be noted that a bias voltage composed only of a direct current of a negative (−) polarity may be applied to the developing powder carrier 4*a*.

In the image forming process of this example, the charge removing lump 7*a* removes charge from the surface of the photoreceptor 2*a* to make the surface into the uniformly charged state with nearly 0V (zero volt) and, after that, the image portions of the photoreceptor 2*a* are positively (+) charged by the writing electrodes 3*b* of the writing device 3, thereby writing an electrostatic latent image onto the photoreceptor 2*a*. Then, negatively (−) charged developing powder 8 conveyed by the developing powder carrier 4*a* of the developing device 4 adheres to the positively (+) charged image portions of the photoreceptor 2*a*, thereby normally developing the electrostatic latent image.

A process illustrated in FIG. 2(*b*) is another example of this image forming process. As shown in FIG. 2(*b*), in this example, a dielectric body 2*b* is employed as the latent image carrier 2 and a charge removing roller 7*b* is employed as the charge control device 7. As in conventional ones, a bias voltage composed of a direct current of a negative (−) polarity may be applied to the developing powder carrier 4*a* of the developing device 4. It should be noted that a bias voltage composed of an alternating current superimposed on a direct current of a negative (−) polarity may be applied to the developing powder carrier 4*a*. On the other hand, a bias voltage composed of an alternating current is applied to the charge removing roller 7*b*. Other structures of this example are the same as those of the aforementioned example shown in FIG. 2(*a*).

In the image forming process of this example, the charge removing roller 7*b* is in contact with the dielectric body 2*b* so as to remove charge from the surface of the dielectric body 2*b* to make the surface into the uniformly charged state with nearly 0V (zero volt). The image forming actions after that are the same as those of the aforementioned example shown in FIG. 2(*a*), except that the dielectric body 2*b* is used instead of the photoreceptor 2*a*.

(2) Making Uniformly Charged State by Removal of Charge—Writing by Contact Application of Charge—Reversal Developing A process shown in FIG. 2(*c*) is an example of this image forming process. As shown in FIG. 2(*c*), in this example, a photoreceptor 2*a* is employed as the latent image carrier 2 and a charge removing lump 7*a* is employed as the charge control device 7 just like the example shown in FIG. 2(*a*). The writing electrodes 3*b* of the writing device 3 are in contact with the photoreceptor 2*a* so that negative (−) charge is mainly transferred (that is, injected) from the writing electrodes 3*b* to non-image portions of the photoreceptor 2*a*, whereby the non-image portions of the photoreceptor 2*a* are negatively (−) charged. Other structures of this example are the same as those of the aforementioned example shown in FIG. 2(*a*).

In the image forming process of this example, the charge removing lump 7*a* removes charge from the surface of the photoreceptor 2*a* to make the surface into the uniformly charged state with nearly 0V (zero volt) and, after that, the non-image portions of the photoreceptor 2*a* are negatively (−) charged by the writing electrodes 3*b* of the writing device 3, thereby writing an electrostatic latent image onto the photoreceptor 2*a*. Then, negatively (−) charged developing powder 8 conveyed by the developing powder carrier 4*a* of the developing device 4 adheres to portions, not negatively (−) charged and having nearly 0V (zero volt), of the photoreceptor 2*a*, thereby reversely developing the electrostatic latent image.

A process illustrated in FIG. 2(*d*) is another example of this image forming process. As shown in FIG. 2(*d*), in this example, a dielectric body 2*b* is employed as the latent image carrier 2 and a charge removing roller 7*b* is employed as the charge control device 7 just like the example shown in FIG. 2(*b*). The writing electrodes 3*b* of the writing device 3 are arranged in contact with the dielectric body 2*b* to negatively (−) charge non-image portions of the dielectric body 2*b*. Other structures of this example are the same as those of the aforementioned example shown in FIG. 2(*b*).

In the image forming process of this example, the charge removing roller 7*b* is in contact with the dielectric body 2*b* so as to remove charge from the surface of the dielectric body 2*b* to make the surface into the uniformly charged state with nearly 0V (zero volt). The image forming actions after that are the same as those of the aforementioned example shown in FIG. 2(*c*), except that the dielectric body 2*b* is used instead of the photoreceptor 2*a*.

(3) Making Uniformly Charged State by Application of Charge—Writing by Contact Removal of Charge—Normal Developing A process shown in FIG. 2(*e*) is an example of this image forming process. As shown in FIG. 2(*e*), in this example, a photoreceptor 2*a* is employed as the latent image carrier 2 and a charging roller 7*c* is employed as the charge control device 7. A bias voltage composed of an alternating current superimposed on a direct current of a positive (+) polarity is applied to the charging roller 7*c* so that the charging roller 7*c* uniformly positively (+) charges the surface of the photoreceptor 2*a*. It should be noted that a bias voltage composed only of a direct current of a positive (+) polarity may be applied to the charging roller 7*c*. In addition, the writing electrodes 3*b* of the writing device 3 are in contact with the photoreceptor 2*a* so that positive (+) charge is mainly transferred (that is, extracted) from the non-image portions of the photoreceptor 2*a* to the writing electrodes 3*b*, whereby positive (+) charge is removed from the non-image portions of the photoreceptor 2*a*. Other structures of this example are the same as those of the aforementioned example shown in FIG. 2(*a*).

In the image forming process of this example, the charging roller 7*c* is arranged in contact with the photoreceptor 2*a* to positively (+) charge the surface of the photoreceptor 2*a* to make the surface into the uniformly charged state with a predetermined voltage and, after that, positive (+) charge is removed from the non-image portions of the photoreceptor 2*a* by the writing electrodes 3*b* of the writing device 3, thereby writing an electrostatic latent image onto the photoreceptor 2*a*. Then, negatively (−) charged developing powder 8 conveyed by the developing powder carrier 4*a* of the developing device 4 adheres to the image portions, positively (+) charged, of the photoreceptor 2*a*, thereby normally developing the electrostatic latent image.

A process illustrated in FIG. 2(*f*) is another example of this image forming process. As shown in FIG. 2(*f*), in this example, a dielectric body 2*b* is employed as the latent image carrier 2 and a corona charging device 7*d* is employed as the charge control device 7. A bias voltage composed of a direct current of a negative (−) polarity or a bias voltage composed of an alternating current superimposed on a direct current of a negative (−) polarity is applied to the corona charging device 7*d*, but not illustrated. The writing electrodes 3*b* of the writing device 3 are arranged in contact with the dielectric body 2*b* to remove negative (−) charge from the non-image portions of the dielectric body 2*b*. Moreover, a bias voltage composed of a direct current of a positive (+) polarity is applied to the developing powder carrier 4*a* so that the developing powder carrier 4*a* conveys positively (+) charged developing powder 8 to the dielectric body 2*b*. It should be noted that a bias voltage composed of an alternating current superimposed on a direct current of a positive (+) polarity may be applied to the developing powder carrier 4*a*. Other structures of this example are the same as those of the aforementioned example shown in FIG. 2(*b*).

In the image forming process of this example, the surface of the dielectric body 2*b* is negatively (−) charged by the corona charging device 7*d* to make the surface of the dielectric body 2*b* into the uniformly charged state with the predetermined voltage and, after that, negative (−) charge is removed from the non-image portions of the dielectric body 2*b* by the writing electrodes 3*b* of the writing device 3, thereby writing an electrostatic latent image on the dielectric body 2*b*. Then, positively (+) charged developing powder 8 conveyed by the developing powder carrier 4*a* of the developing device 4 adheres to the image portions, negatively (−) charged, of the dielectric body 2*b*, thereby normally developing the electrostatic latent image.

(4) Making Uniformly Charged State by Application of Charge—Writing by Contact Removal of Charge—Reversal Developing A process shown in FIG. 2(*g*) is an example of this image forming process. As shown in FIG. 2(*g*), in this example, a photoreceptor 2*a* is employed as the latent image carrier 2 and a charging roller 7*c* is employed as the charge control device 7. A bias voltage composed of an alternating current superimposed on a direct current of a negative (−) polarity is applied to the charging roller 7*c* so that the charging roller 7*c* uniformly negatively (−) charges the surface of the photoreceptor 2*a*. It should be noted that a bias voltage composed only of a direct current of a negative (−) polarity may be applied to the charging roller 7*c*. The writing electrodes 3*b* of the writing device 3 are in contact with the photoreceptor 2*a* so that negative (−) charge is transferred (that is, extracted) from the image portions of the photoreceptor 2*a* to the writing electrodes 3*b*, whereby negative (−) charge is removed from the image portions of the photoreceptor 2*a*. Other structures of this example are the same as those of the aforementioned example shown in FIG. 2(*a*).

In the image forming process of this example, the charging roller 7*c* is arranged in contact with the photoreceptor 2*a* to negatively (−) charge the surface of the photoreceptor 2*a* to make the surface into the uniformly charged state with a predetermined voltage and, after that, negative (−) charge is removed from the image portions of the photoreceptor 2*a* by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to the image portions, not negatively (−) charged, of the photoreceptor 2*a*, thereby reversely developing the electrostatic latent image.

A process illustrated in FIG. 2(*h*) is another example of this image forming process. As shown in FIG. 2(*h*), in this example, a dielectric body 2*b* is employed as the latent image carrier 2 and a corona charging device 7*d* is employed as the charge control device 7. A bias voltage composed of a direct current of a positive (+) polarity or a bias voltage composed of an alternating current superimposed on a direct current of a positive (+) polarity is applied to the corona charging device 7*d*, but not illustrated. Other structures of this example are the same as those of the aforementioned example shown in FIG. 2(*f*).

In the image forming process of this example, the surface of the dielectric body 2*b* is positively (+) charged by the corona charging device 7*d* to make the surface of the dielectric body 2*b* into the uniformly charged state with the predetermined voltage and, after that, positive (+) charge is removed from the image portions of the dielectric body 2*b* by the writing electrodes 3*b* of the writing device 3, thereby writing an electrostatic latent image onto the dielectric body 2*b*. Then, positively (+) charged developing powder 8 conveyed by the developing roller 4*a* of the developing device 4 adheres to the image portions, not positively (+) charged, of the dielectric body 2*b*, thereby reversely developing the electrostatic latent image.

Figure 3:
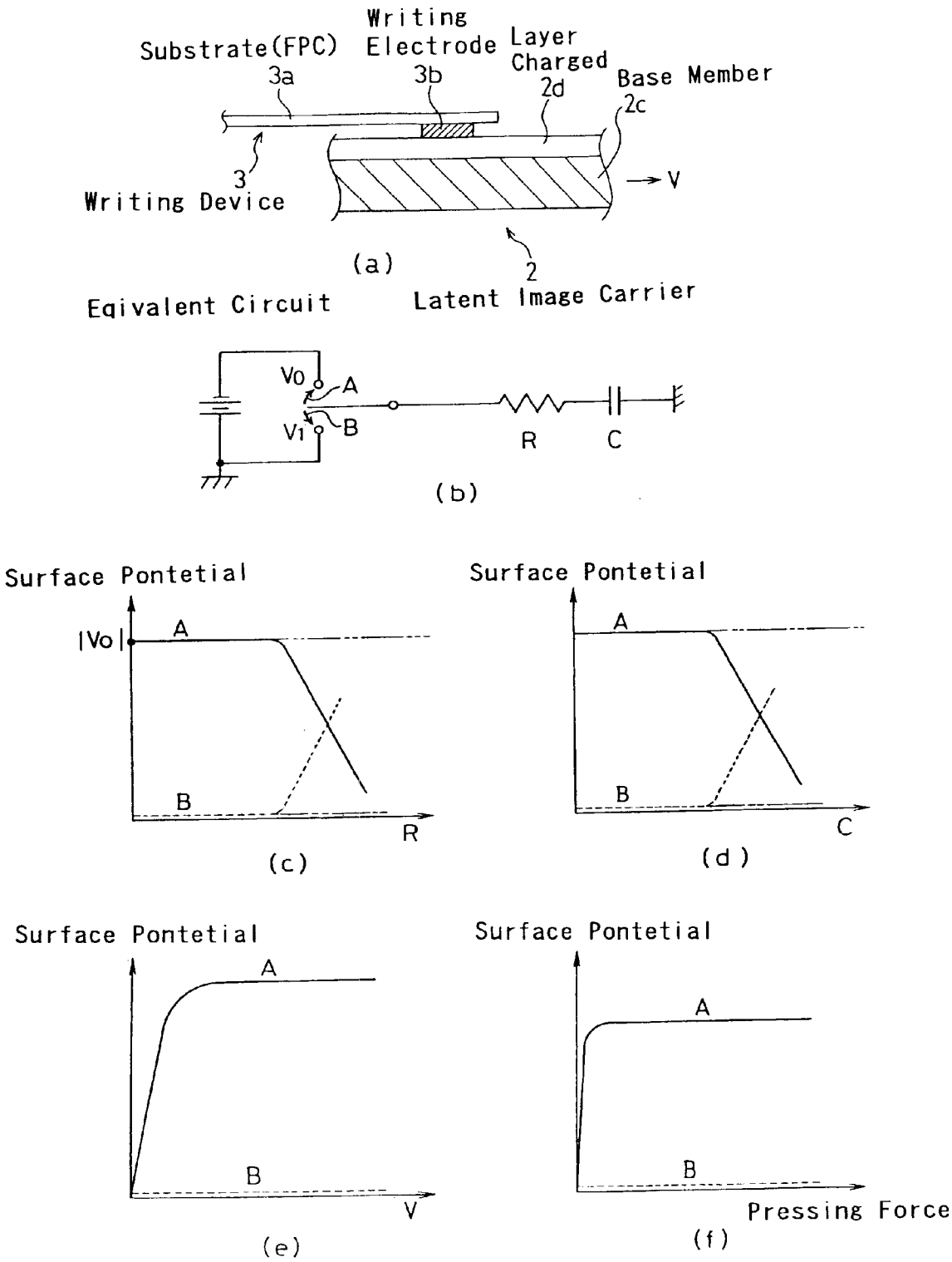
FIG. 3, parts (a)–(f), are views for explaining the principle of writing an electrostatic latent image by writing electrodes of a writing device through application or removal of charge, wherein part (a) is an enlarged view of a portion where a writing electrode is in contact with the latent image carrier, part (b) is a diagram of an electrical equivalent circuit of the contact portion, and parts (c)–(f) are graphs each showing the relation between each parameter and the surface potential of the latent image carrier.

FIGS. 3(*a*)–3(*f*) are views for explaining the principle of writing an electrostatic latent image by the writing electrodes 3*b* of the writing device 3 through application or removal of charge, wherein FIG. 3(*a*) is an enlarged view of a contact portion where a writing electrode 3*b* is in contact with the latent image carrier 2, FIG. 3(*b*) is a diagram of an electrical equivalent circuit of the contact portion, and FIGS. 3(*c*)–3(*f*) are graphs each showing the relation between each parameter and the surface potential of the latent image carrier 2.

As shown in FIG. 3(*a*), the latent image carrier 2 comprises a base member 2*c* which is made of a conductive material such as aluminum and is grounded and an insulating charged layer 2*d* formed on the outer periphery of the base member 2*c*. The writing electrodes 3*b* supported by the substrate 3*a* made of FPC or the like of the writing device 3 are in contact with the charged layer 2*d* with a predetermined small pressing force and the latent image carrier 2 travels (rotates) at a predetermined speed "v". As the aforementioned small pressing force, 10N or less per 300 mm in width, that is, a linear load of 0.03 N/mm or less is preferable for stabilizing the contact between the writing electrodes 3*b* and the latent image carrier 2 and for stabilizing the charge-transfer therebetween. In view of abrasion, it is preferable to achieve the smallest possible linear load while keeping the contact stability.

Either of a predetermined high voltage $V_0$ and a predetermined low voltage $V_1$ is selectively impressed to the writing electrodes 3*b* through the substrate 3*a* (as mentioned, since there are positive and negative charges, the high voltage is a voltage having a high absolute value and the low voltage is a voltage of the same polarity as the high voltage and having a low absolute value or 0V (zero volt). In the description of the present invention in this specification, the low voltage is a ground voltage. In the following description, therefore, the high voltage $V_0$ is referred to as the predetermined voltage $V_0$ and the low voltage $V_1$ is referred to as the ground voltage $V_1$. It should be understood that the ground voltage $V_1$ is 0V (zero volt.)

That is, the contact portion (nip) between each writing electrode 3*b* and the latent image carrier 2 is provided with an electrical equivalent circuit shown in FIG. 3(*b*). In FIG. 3(*b*), "R" designates the resistance of the writing electrode 3*b* and "C" designates the capacity of the latent image carrier 2. The resistance R of the writing electrode 3*b* is selectively switched to be connected to the A side of the predetermined voltage $V_0$ of a negative (−) polarity or to the B side of the ground voltage $V_1$.

FIG. 3(*c*) shows the relation between the resistance R of the writing electrode 3*b* and the surface potential of the latent image carrier 2. The aforementioned relation when the writing electrode 3*b* is connected to the A side in the electrical equivalent circuit to impress the predetermined voltage $V_0$ of a negative (−) polarity to the writing electrode 3*b* is represented by a solid line in FIG. 3(*c*). As shown by the solid line in FIG. 3(*c*), the surface potential of the latent image carrier 2 is constant at the predetermined voltage $V_0$ in a region where the resistance R of the writing electrode 3*b* is small, and the absolute value of the surface potential of the latent image carrier 2 decreases in a region where the resistance R of the writing electrode 3*b* is greater than a predetermined value. On the other hand the relation between the resistance R of the writing electrode 3*b* and the surface potential of the latent image carrier 2 when the writing electrode 3*b* is connected to the B side to ground the electrode 3*b* is represented by a dotted line in FIG. 3(*c*). As shown by the dotted line in FIG. 3(*c*), the surface potential of the latent image carrier 2 is constant at substantially the ground voltage $V_1$ in a region where the resistance R of the writing electrode 3*b* is small, and the absolute value of the surface potential of the latent image carrier 2 increases in a region where the resistance R of the writing electrode 3*b* is greater than the predetermined value.

Figure 4:
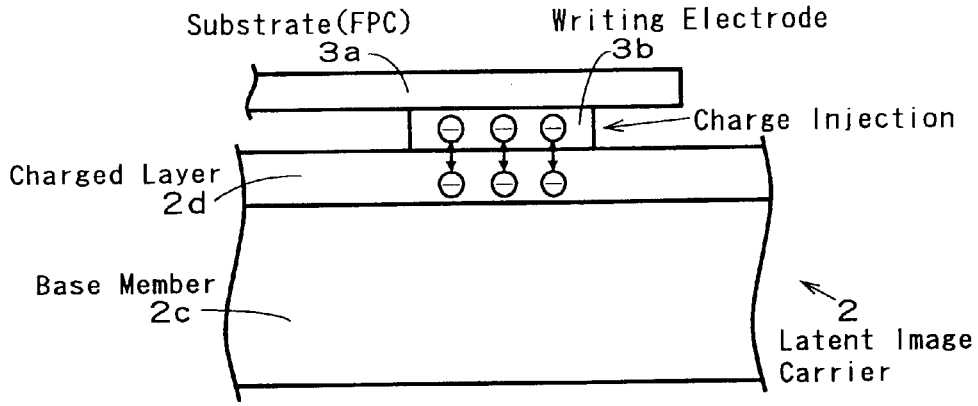
FIG. 4, parts (a)–(c) are views for explaining the application or removal of charge relative to the latent image carrier, wherein part (a) is a view for explaining the application or removal of charge relative to the latent image carrier via the charge-transfer, part (b) is a view for explaining the application or removal of charge relative to the latent image carrier via the discharge, and part (c) is a graph for explaining Paschen's law.
Figure 4:
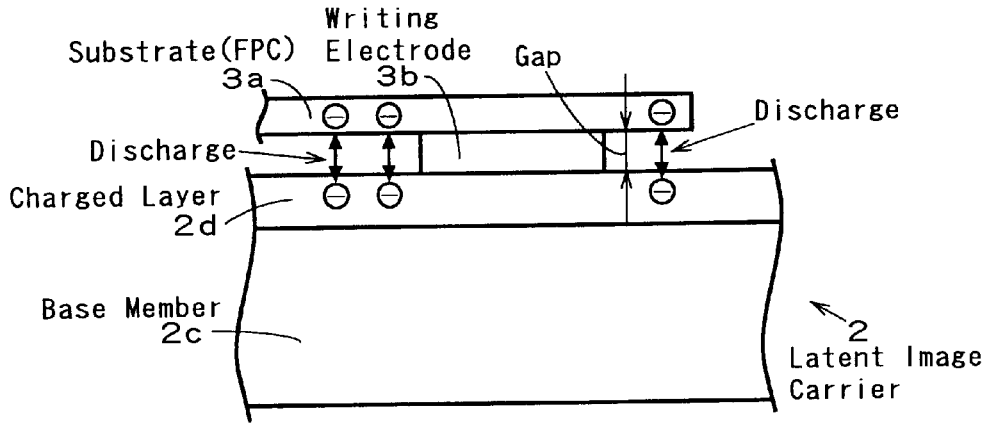
Figure 4:
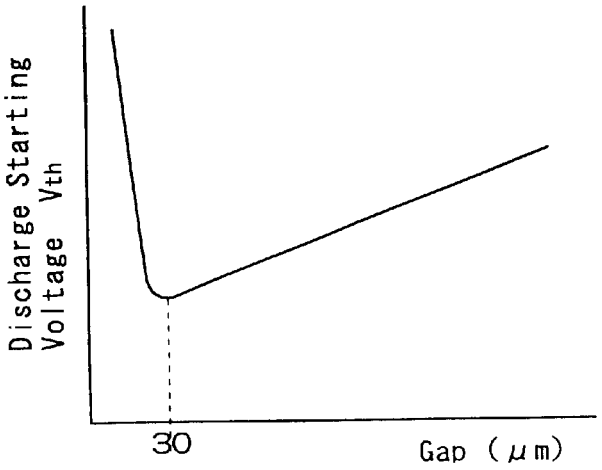

In the region where the resistance R of the writing electrode 3*b* is small and the surface potential of the latent image carrier 2 is constant at the predetermined voltage $V_0$ or constant at the ground voltage $V_1$, negative (−) charge directly moves from a lower voltage side to a higher voltage side, that is, the charge-transfer is conducted between the writing electrode 3*b* being in contact with the latent image carrier 2 and the charged layer 2*d* of the latent image carrier 2, as shown in FIG. 4(*a*). This means that charge is applied to or removed from the latent image carrier 2 via the charge-transfer. In the region where the resistance R of the writing electrode 3*b* is great and the surface potential of the latent image carrier 2 starts to vary, the application or removal of charge relative to the latent image carrier 2 via the charge-transfer is gradually reduced and discharge occurs between the substrate 3*a* and the base member 2*c* of the latent image carrier 2 as shown in FIG. 4(*b*) as the resistance R of the writing electrode 3*b* is increased.

The discharge between the substrate 3*a* and the base member 2*c* of the latent image carrier 2 occurs when the absolute value of the voltage (the predetermined voltage $V_0$) between the substrate 3*a* and the base member 2*c* of the latent image carrier 2 becomes higher than a discharge starting voltage $V_{th}$. The relation between the gap, between the substrate 3*a* and the latent image carrier 2, and the discharge starting voltage $V_{th}$ is just as shown in FIG. 4(*c*), according to Paschen's law. That is, the discharge starting voltage $V_{th}$ is the lowest when the gap is about 30 $\mu$m, so the discharge starting voltage $V_{th}$ should be high when the gap is either larger or smaller than about 30 $\mu$m, making the occurrence of discharge difficult. Even via the discharge, charge can be applied to or removed from the surface of the latent image carrier 2. However, when the resistance R of the writing electrode 3*b* is in this region, the application or removal of charge relative to the latent image carrier 2 via the charge-transfer is greater while the application or removal of charge relative to the latent image carrier 2 via the discharge is smaller. This means that the application or removal of charge relative to the latent image carrier 2 is dominated by the application or removal of charge via the charge-transfer. By the application or removal of charge via the charge-transfer, the surface potential of the latent image carrier 2 becomes to the predetermined voltage $V_0$ to be impressed to the writing electrode 3*d* or the ground voltage $V_1$. In case of the application of charge via the charge-transfer, the predetermined voltage $V_0$ to be supplied to the writing electrode 3*b* is preferably set to a voltage equal to or less than the discharge starting voltage $V_{th}$ at which the discharge occurs between the writing electrode 3*b* and the base member 2*c* the latent image carrier 2.

When the resistance R of the writing electrode 3*b* is greater than the region, the application or removal of charge relative to the latent image carrier 2 via the charge-transfer is smaller while the application or removal of charge relative to the latent image carrier 2 via the discharge is greater than that via the charge-transfer. The application or removal of charge relative to the latent image carrier 2 gradually becomes dominated by the application or removal of charge via the discharge. That is, as the resistance R of the writing electrode 3*b* becomes greater, the application or removal of charge relative to the surface of the latent image carrier 2 is performed mainly via the discharge and rarely via the charge-transfer. By the application or removal of charge via the discharge, the surface potential of the latent image carrier 2 becomes to a voltage obtained by subtracting the discharge starting voltage $V_{th}$ from the predetermined voltage $V_0$ to be impressed to the writing electrode 3*d* or the ground voltage $V_1$. It should be noted that the same is true when the predetermined voltage $V_0$ is of a positive (+) polarity.

Therefore, the application or removal of charge relative to the latent image carrier 2 via the charge-transfer can be achieved by satisfying a condition that the resistance R of the electrode 3*b* is set in such a small range as to allow the surface potential of the latent image carrier 2 to be constant at the predetermined voltage $|V_0|$ (this is an absolute value because voltages of opposite (±) polarities are available) or constant at the ground voltage $V_1$ and by controlling the voltage to be impressed to the writing electrode 3*b* to be switched between the predetermined voltage $V_0$ and the ground $V_1$.

FIG. 3(*d*) shows the relation between the capacity C of the latent image carrier 2 and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*d*). As shown by the solid line in FIG. 3(*d*), the surface potential of the latent image carrier 2 is constant at the predetermined voltage $V_0$ in a region where the capacity C of the latent image carrier 2 is small, and the absolute value of the surface potential of the latent image carrier 2 decreases in a region where the capacity C of the latent image carrier 2 is larger than a predetermined value. On the other hand, the relation between the capacity C of the latent image carrier 2 and the surface potential of the latent image carrier 2 when the writing electrode 3*b* is connected to the B side to ground the writing electrode 3*b* is represented by a dotted line in FIG. 3(*d*). As shown by the dotted line in FIG. 3(*d*), the surface potential of the latent image carrier 2 is constant at substantially the ground voltage $V_1$ in a region where the capacity C of the latent image carrier 2 is small, and the absolute value of the surface potential of the latent image carrier 2 increases in a region where the capacity C of the latent image carrier 2 is larger than a predetermined value.

In the region where the capacity C of the latent image carrier 2 is small and the surface potential of the latent image carrier 2 is constant at the predetermined voltage $V_0$ or constant at the ground voltage $V_1$, negative (−) charge is directly transferred between the writing electrode 3*b* being in contact with the latent image carrier 2 and the charged layer 2*d* of the latent image carrier 2. That is, charge is applied to or removed from the latent image carrier 2 via the charge-transfer. In the region where the capacity C of the latent image carrier 2 is large and the surface potential of the latent image carrier 2 starts to vary, the application or removal of charge relative to the latent image carrier 2 via the charge-transfer is gradually reduced and discharge is started between the substrate 3*a* and the latent image carrier 2 as shown in FIG. 4(*b*) as the capacity C of the latent image carrier 2 is increased. Even via the discharge, charge can be applied to or removed from the surface of the latent image carrier 2. However, when the capacity C of the latent image carrier 2 is in this region, the application or removal of charge relative to the latent image carrier 2 via the charge-transfer is greater while the application or removal of charge relative to the latent image carrier 2 via the discharge is smaller. This means that the application or removal of charge relative to the latent image carrier 2 is dominated by the application or removal of charge via the charge-transfer. By the application or removal of charge via the charge-transfer, the surface potential of the latent image carrier 2 becomes to the predetermined voltage $V_0$ to be impressed to the writing electrode 3*d* or the ground voltage $V_1$.

When the capacity C of the latent image carrier 2 is greater than the region, there is now little charge-transfer between the writing electrode 3*b* and the charged layer 2*d* of the latent image carrier 2. This means that little or no charge is applied to or removed from the latent image carrier 2 via the charge-transfer. It should be noted that the same is true when the predetermined voltage $V_0$ is of a positive (+) polarity.

Therefore, the application or removal of charge relative to the latent image carrier 2 via the charge-transfer can be achieved by satisfying a condition that capacity C of the latent image carrier 2 is set in such a small range as to allow the surface potential of the latent image carrier 2 to be constant at the predetermined voltage $|V_0|$ (this is an absolute value because voltages of opposite (±) polarities are available) or constant at the ground voltage $V_1$ and by controlling the voltage to be impressed to the writing electrode 3*b* to be switched between the predetermined voltage $V_0$ and the ground voltage $V_1$.

FIG. 3(*e*) shows the relation between the velocity (peripheral velocity) v of the latent image carrier 2 and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*e*). As shown by the solid line in FIG. 3(*e*), the surface potential of the latent image carrier 2 increases as the velocity v increases in a region where the velocity v of the latent image carrier 2 is relatively low, and the absolute value of the surface potential of the latent image carrier 2 is constant in a region where the velocity v of the latent image carrier 2 is higher than a predetermined value. The reason of increase in the surface potential of the latent image carrier 2 with the increase in the velocity v of the latent image carrier 2 is considered as the charge-transfer to the latent image carrier 2 due to friction between the writing electrode 3*b* and the latent image carrier 2. The velocity v of the latent image carrier 2 has an extent above which the charge-transfer due to friction is no longer increased and becomes substantially constant. On the other hand, the relation between the velocity v of the latent image carrier 2 and the surface potential of the latent image carrier 2 when the writing electrode 3*b* is connected to the B side to ground the writing electrode 3*b* is represented by a dotted line in FIG. 3(*e*). As shown by the dotted line in FIG. 3(*e*), the surface potential of the latent image carrier 2 is constant at the ground voltage $V_1$ regardless of the velocity v of the latent image carrier 2. It should be noted that the same is true when the predetermined voltage $V_0$ is of a positive (+) polarity.

FIG. 3(*f*) shows the relation between the pressing force applied to the latent image carrier 2 by the writing electrode 3*b* (hereinafter, just referred to as "the pressure of the writing electrode 3*b*") and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*f*). As shown by the solid line in FIG. 3(*f*), the surface potential of the latent image carrier 2 relatively rapidly increases as the pressure of the writing electrode 3*b* increases in a region where the pressure of the writing electrode 3*b* is very low, and the absolute value of the surface potential of the latent image carrier 2 is constant in a region where the pressure of the writing electrode 3*b* is higher than a predetermined value. The reason of the rapid increase in the surface potential of the latent image carrier 2 with the increase in the pressure of the writing electrode 3*b* is considered as that the contact between the writing electrode 3*b* and the latent image carrier 2 is further ensured by the increase in the pressure of the writing electrode 3*b*. The pressure of the writing electrode 3*b* has an extent above which the contact certainty between the writing electrode 3*b* and the latent image carrier 2 is no longer increased and becomes substantially constant. On the other hand, the relation between the pressure of the writing electrode 3*b* and the surface potential of the latent image carrier 2 when the writing electrode 3*b* is connected to the B side to ground the writing electrode 3*b* is represented by a dotted line in FIG. 3(*f*). As shown by the dotted line in FIG. 3(*f*), the surface potential of the latent image carrier 2 is constant at the ground voltage $V_1$ regardless of the pressure of the writing electrode 3*b*. It should be noted that the same is true when the predetermined voltage $V_0$ is of a positive (+) polarity.

Therefore, the application or removal of charge relative to the latent image carrier 2 via the charge-transfer can be securely and easily achieved by satisfying conditions that the resistance R of the writing electrode 3*b* and the capacity C of the latent image carrier 2 are set in such a manner as to allow the surface potential of the latent image carrier 2 to be constant at the predetermined voltage and that the velocity v of the latent image carrier 2 and the pressure of the writing electrode 3*b* are set in such a manner as to allow the surface potential of the latent image carrier 2 to be constant at the predetermined voltage, and by controlling the voltage to be impressed to the writing electrode 3*b* to be switched between the predetermined voltage $V_0$ and the ground voltage $V_1$.

Though the predetermined voltage $V_0$ to be impressed to the writing electrode 3*b* is a direct current voltage in the aforementioned embodiment, an alternating current voltage may be superimposed on a direct current voltage. When an alternating current voltage is superimposed, it is preferable that a DC component is set to be a voltage to be impressed to the latent image carrier 2, the amplitude of AC component is set to be twice or more as large as the discharge starting voltage $V_{th}$, and the frequency of AC component is set to be higher than the frequency in rotation of the latent image carrier 2 by about 500–1,000 times (for example, assuming that the diameter of the latent image carrier 2 is 30ϕ and the peripheral velocity of the latent image carrier 2 is 180 mm/sec, the frequency in rotation of the latent image carrier 2 is 2 Hz so that the frequency of AC component is 1,000–2,000 Hz.).

By superimposing an alternating current voltage on a direct current voltage as mentioned above, the application or removal of charge via discharge of the writing electrode 3*b* is further stabilized. In addition, the writing electrode vibrates because of the existence of the alternating current, thereby removing foreign matters adhering to the writing electrode 3*b* and thus preventing contamination of the writing electrode 3*b*.

Figure 5:
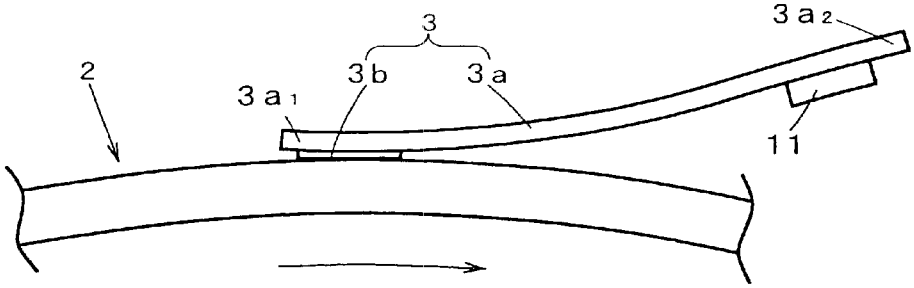
FIG. 5 is a schematic illustration showing an example of the writing device, as seen in an axial direction of the latent image carrier.

Description will now be made as regard to the flexible substrate 3*a* supporting the writing electrodes 3*b* of the writing device 3. FIG. 5 is a schematic illustration showing an example of the writing device 3, as seen in an axial direction of the latent image carrier 2. As mentioned, the substrate 3*a* is made of a flexible material being relatively soft and elastic such as a FPC. The substrate 3*a* has a plurality of writing electrodes 3*b* fixed at its end $3a_1$ as shown in FIG. 5. The writing electrodes 3*b* are aligned in a row extending in the axial direction (main scanning direction) of the latent image carrier 2 as will be described later and the substrate 3*a* is accordingly formed in a rectangular plate shape having a length, along the axial direction of the latent image carrier 2, which is substantially the same as the axial length of the charged layer 2*d* of the latent image carrier 2. The substrate 3*a* is fixed by a suitable fixing member at an end $3a_2$ opposite to the end $3a_1$ where the writing electrodes 3*b* are fixed. The substrate 3*a* is disposed to extend from the right side in FIG. 5 to oppose the rotational direction (indicated by an arrow: the clockwise direction) of the latent image carrier 2. It should be noted that the substrate 3*a* may be disposed to extend from the left side in FIG. 5 in the same direction as the rotational direction of the latent image carrier 2.

In this state, the substrate 3*a* is elastically slightly deflected to produce weak elastic restoring force. By this elastic restoring force, the writing electrodes 3*b* are lightly pressed against and in contact with the latent image carrier 2 with a small pressing force. The fact that the pressing force of the writing electrodes 3*b* onto the latent image carrier 2 is small can suppress the wearing of the charged layer 2*d* of the latent image carrier 2 due to the writing electrodes 3*b*, thus improving the durability. The fact that the writing electrodes 3*b* are kept in contact with the charged layer 2*d* by the elastic force of the substrate 3*a* achieves stable contact of the writing electrodes 3*b* to the charged layer 2*d*. The substrate 3*a* has drivers 11 fixed to the end $3a_2$ for controlling the operation of the writing electrodes 3*b*.

In case where the substrate 3*a* is disposed to oppose the rotational direction of the latent image carrier 2 as shown in FIG. 5, the substrate 3*a* can remove foreign matters adhering to the latent image carrier 2, that is, the writing head 3 is provided with a cleaning characteristic. In case where the substrate 3*a* is disposed to extent in the same direction of the rotational direction of the latent image carrier 2, foreign matters adhering to the latent image carrier 2 are allowed to pass between the substrate 3*a* and the latent image carrier 2.

Figure 6:
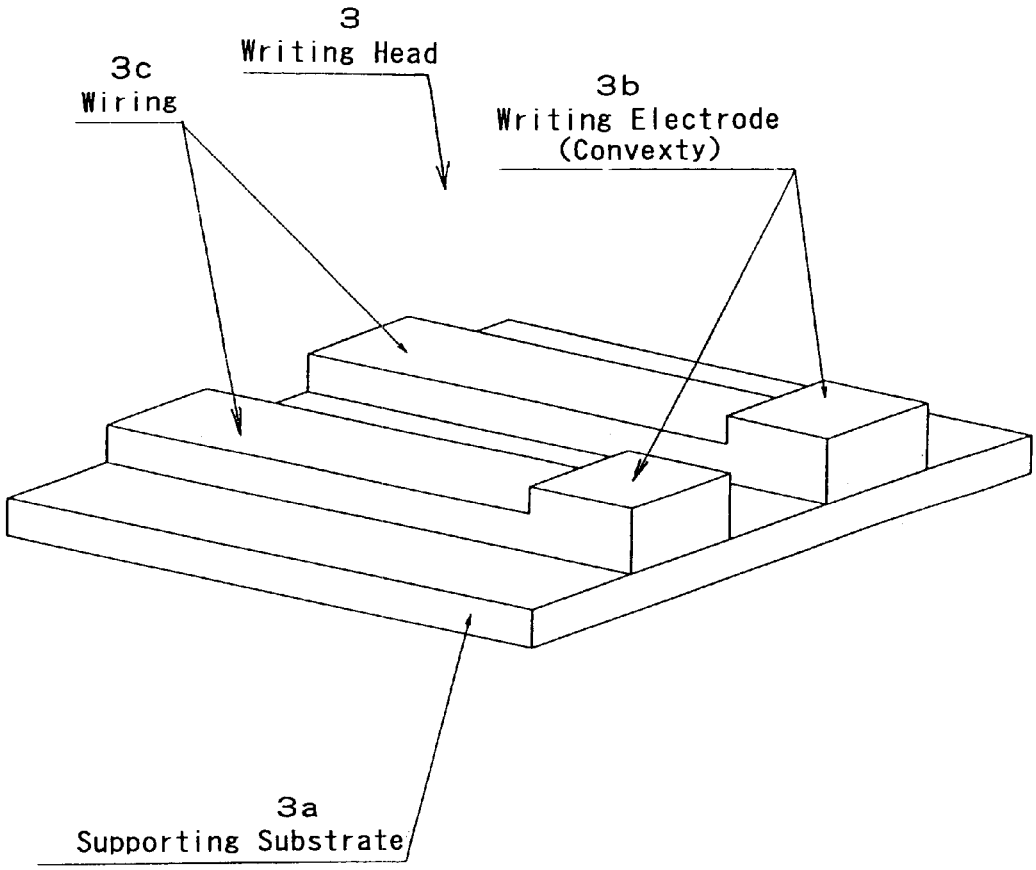
FIG. 6 is a perspective view partially showing the writing head in the image forming apparatus of the embodiment shown in FIG. 3 through 5.

FIG. 6 is a perspective view partially showing the writing head in the image forming apparatus of this embodiment.

The writing head shown in FIG. 3(*a*) through FIG. 5 comprises a supporting substrate 3*a* made of a flexible material such as FPC of PET, a plurality of wirings 3*c* (only two wirings are illustrated in FIG. 6) which are made of a conductive material and are placed on the supporting substrate 3*a*, each wiring 3*c* extending in the direction perpendicular to the main scanning direction of the latent image carrier 2, and writing electrodes 3*b* each of which is formed at one end of each wiring 3*c* and is composed of a convexity in a rectangular parallelopiped or a cube form to project toward the latent image carrier 2 as shown in FIG. 6. Therefore, the writing electrodes 3*b* are aligned in the main scanning direction. It should be noted that the other end of each writing 3*c* is connected to a driver 11 as will be described later.

Figure 7:
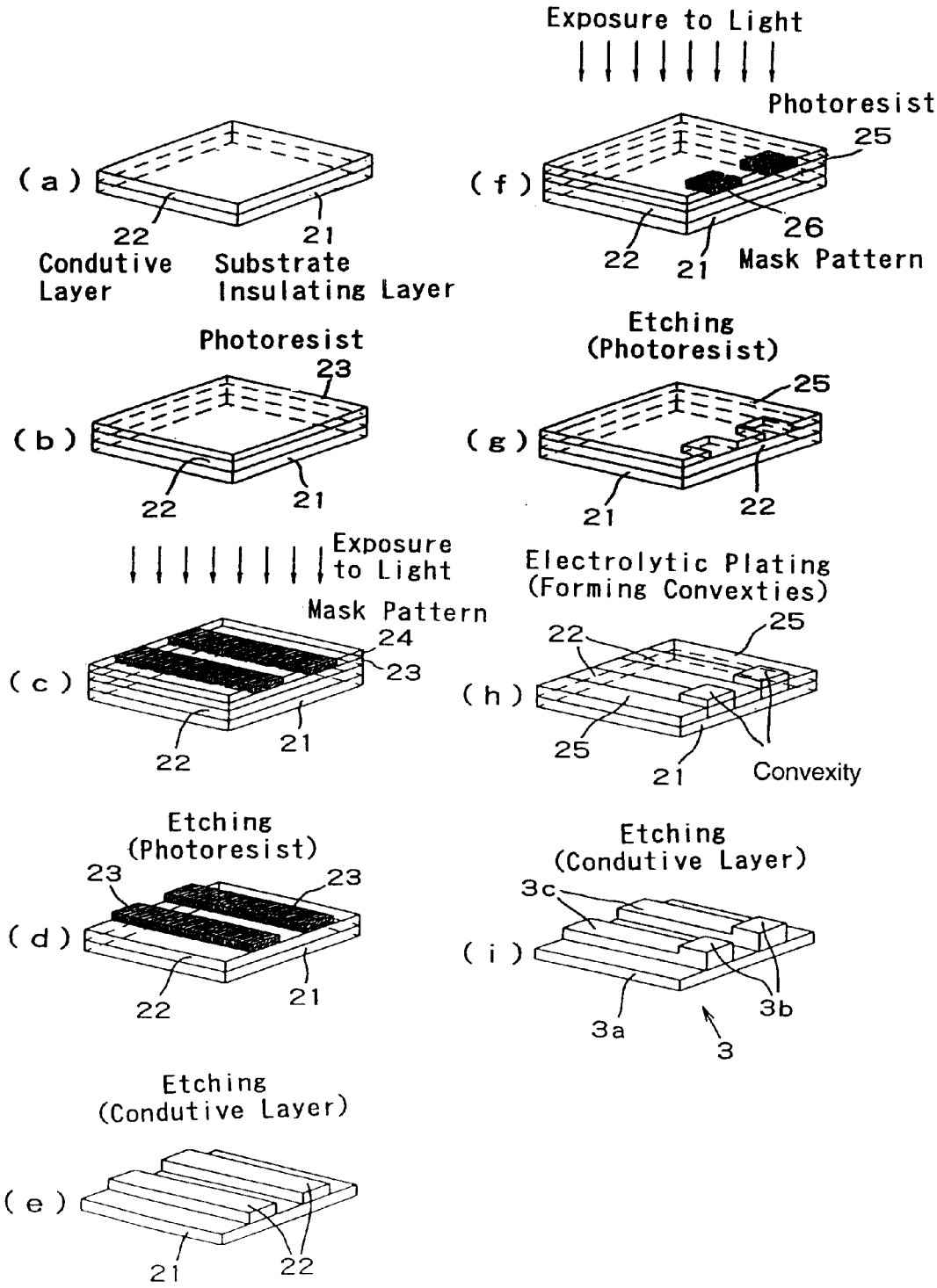
FIG. 7, parts (a)–(i), are views for explaining one example of the method for manufacturing the writing head shown in FIG. 6.

FIGS. 7(*a*) through 7(*i*) are views for explaining one example of the method for manufacturing the writing head shown in FIG. 6.

The method for forming the writing electrodes 3*b* composed of convexities aligned in the main scanning direction comprises: superposing and bonding a conductive layer 22 such as Cu onto a substrate insulating layer 21 which is elastically flexible as shown in FIG. 7(*a*); and then coating the conductive layer 22 with a photoresist 23 as shown in FIG. 7(*b*). The coating of the photoresist 23 may be conducted by laminating a dry film on the conductive layer 22 or by applying liquid photoresist onto the conductive layer 22 using a technique of dip coating.

After that, as shown in FIG. 7(*c*), a mask pattern 24 corresponding to a wiring pattern 9 as will be described later is put on the photoresist 23 and is then exposed to light. As shown in FIG. 7(*d*), sensitized portions of the photoresist 23 are removed by etching and the mask pattern is then removed so as to expose portions of the conductive layer 22. After that, as shown in FIG. 7(*e*), the portions of the conductive layer 22 exposed due to the removal of the photoresist 23 are removed by acid (sulfuric acid) etching and residual portions of the photoresist (non-etched portions of the photoresist) 23 are also removed.

Then, as shown in FIG. 7(*f*), another photoresist 25 is formed on the substrate insulating layer 21 and the residual portions of the conductive layer 22 to coat them by the same coating method as mentioned above. Another mask pattern 26 is prepared which is designed to sensitize portions of the photoresist 25 corresponding to locations, where the electrode convexities should be formed, on the residual portions of the conductive layer 22. The mask pattern 26 is put on the photoresist 25 and is then exposed to light. Sensitized portions of the photoresist 25, i.e. the portions of the photoresist 25 where the electrode convexities should be formed are removed by etching so that the corresponding portions of the conductive layer 22 are exposed as shown in FIG. 7(*g*).

After that, as shown in FIG. 7(*h*), the exposed portions of the conductive layer 22 are processed by electrolytic plating 27 to form rectangular parallelopiped or cubic convexities. Finally, as shown in FIG. 7(*i*), the residual photoresist 25, the most front layer, is removed by etching, thereby manufacturing a writing head, as shown in FIG. 6, on which wirings 3*c* and writing electrodes 3*b* composed of rectangular parallelopiped or cubic convexities are formed.

It should be understood that the method of manufacturing the writing head having writing electrodes 3*b* composed of convexities is not limited to the method illustrated in FIGS. 7(*a*)–7(*i*) and any suitable method which can form electrodes composed of convexities and wirings on a flexible substrate 3*a* may be employed.

Figure 8:
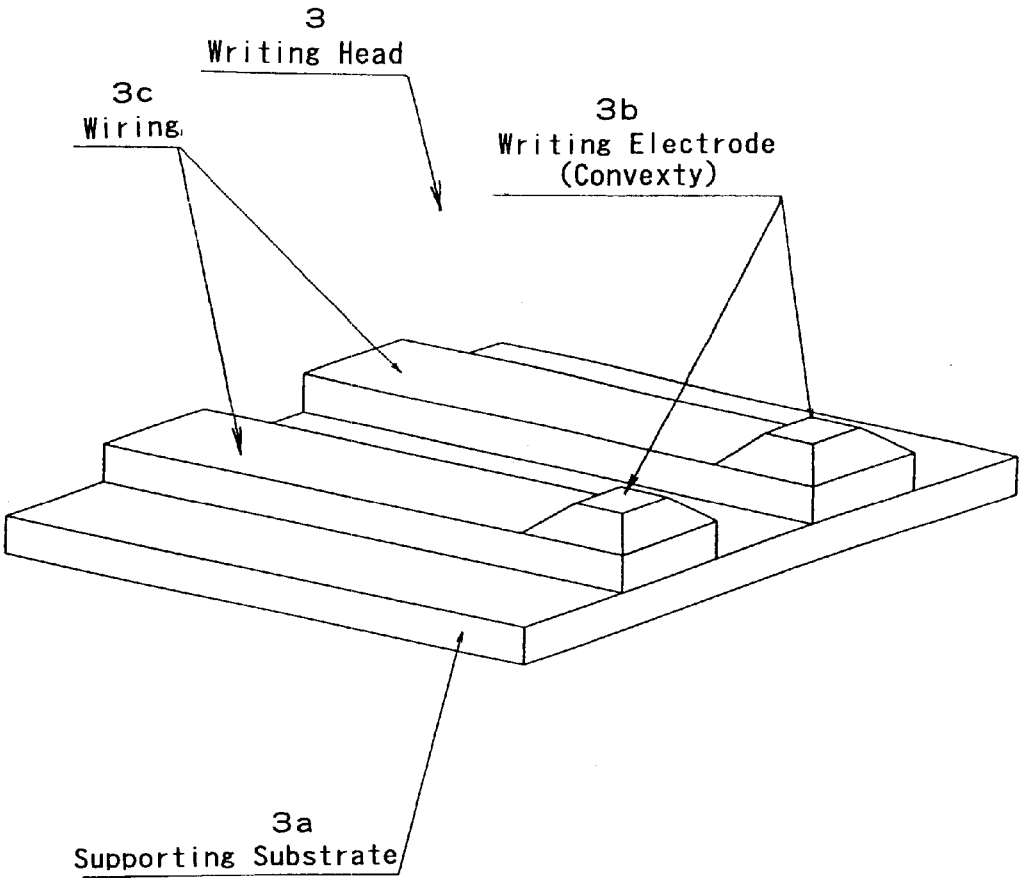
FIG. 8 is a perspective view similar to FIG. 6, but partially showing another example of the writing head in the image forming apparatus of the embodiment shown in FIG. 3 through FIG. 5.
Figure 9:
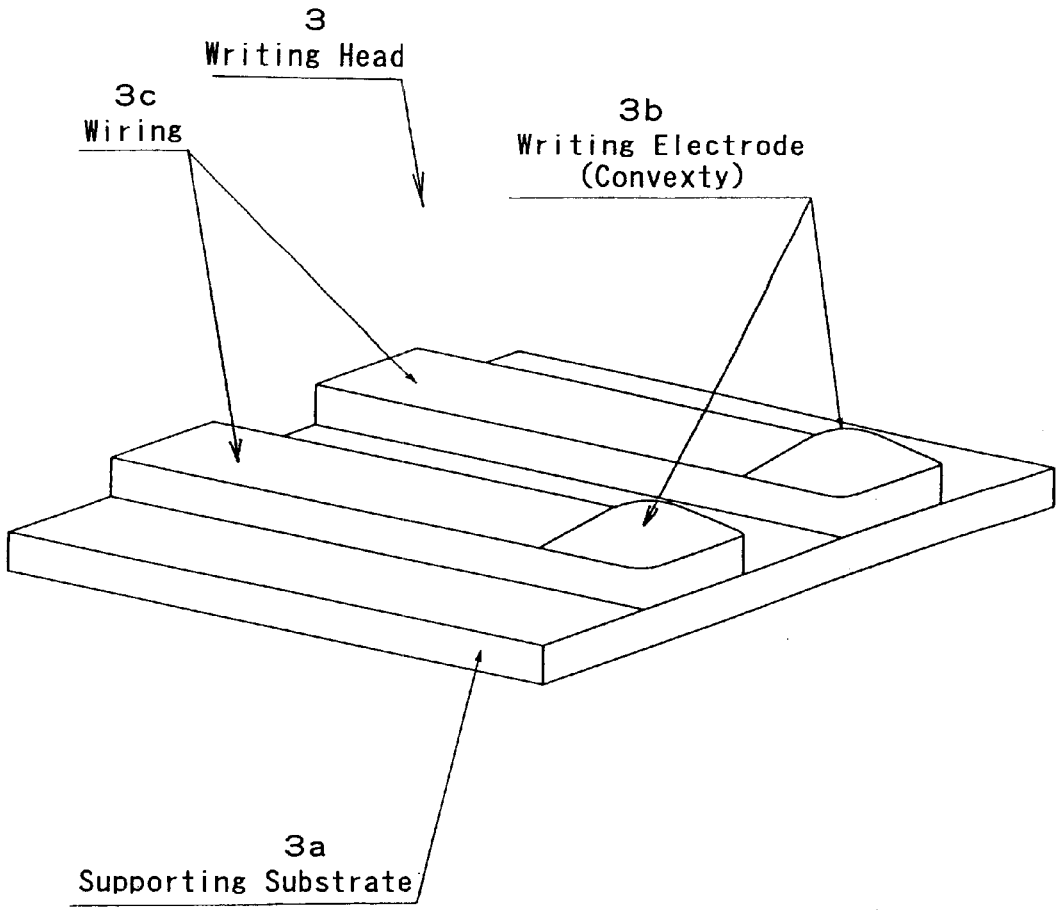
FIG. 9 is a perspective view similar to FIG. 6, but partially showing another example of the writing head in the image forming apparatus of the embodiment shown in FIG. 3 through FIG. 5.
Figure 10:
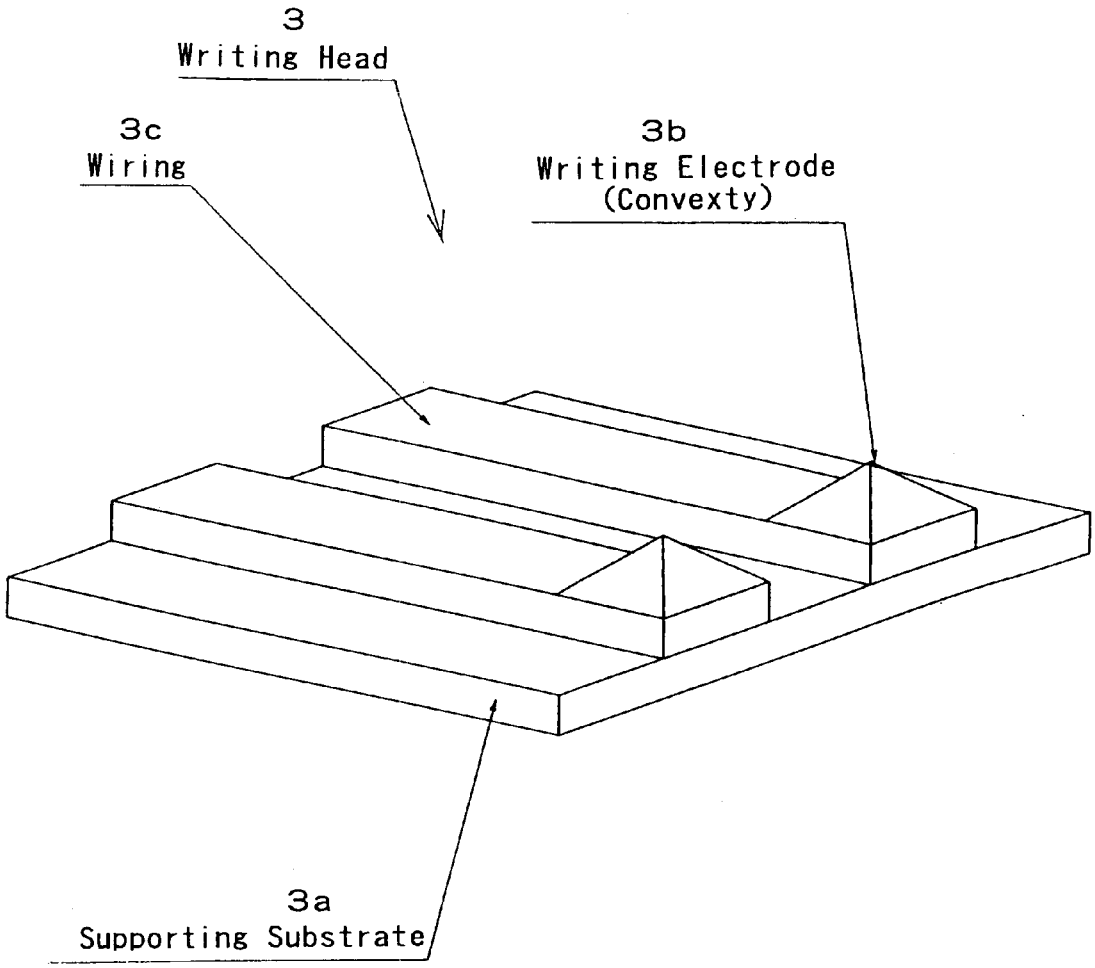
FIG. 10 is a perspective view similar to FIG. 6, but partially showing another example of the writing head in the image forming apparatus of the embodiment shown in FIG. 3 through FIG. 5.

FIG. 8 through FIG. 10 are perspective views similar to FIG. 6, but partially showing another embodiments of the writing head in the image forming apparatus of this embodiment.

In the writing head 3 of the example shown in FIG. 6, each convexity composing each writing electrode 3*b* is formed in a rectangular parallelopiped or a cube. However, in the writing head 3 of the example shown in FIG. 8, each convexity composing each writing electrode 3*b* is formed in a truncated square pyramid. In the writing head 3 of the example shown in FIG. 9, each convexity is formed by rounding off the top peripheral edges of a truncated square pyramid of the example shown in FIG. 8. Further, in the writing head 3 of the example shown in FIG. 10, each convexity composing each writing electrode 3*b* is formed in a square pyramid. Furthermore, as the configuration of the convexity, various configurations are available, including a circular column, a cone, a truncated cone, an elliptic column (column of which cross section is elliptic), an elliptic cone (cone of which cross section is elliptic), a truncated elliptic cone (truncated cone of which cross section is elliptic), an oval column (column of which cross section is oval), an oval cone (cone of which cross section is oval), a truncated oval cone (truncated cone of which cross section is oval), a triangle column, a triangle pyramid, a truncated triangle pyramid, a square column, a polygonal column (having five corners or more), a polygonal pyramid (having five corners or more), and a truncated polygonal pyramid (having five corners or more). The cross section of the square column, the square pyramid, and the truncated square pyramid may be rectangular, quadratic, parallelogramatic, trapezoidal and the like.

Figure 11:
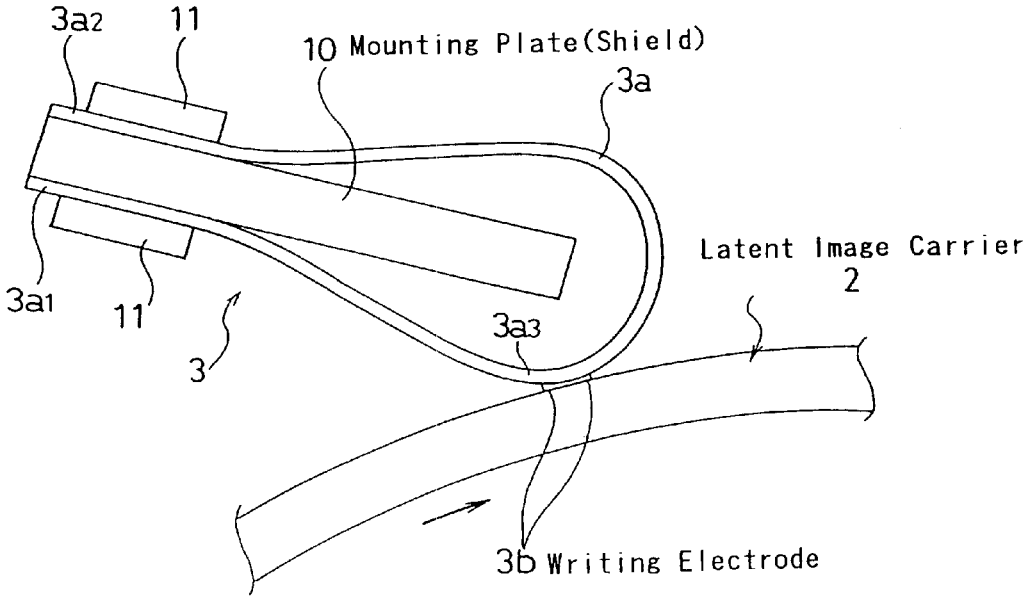
FIG. 11 is a schematic illustration showing another example of the writing device, as seen in an axial direction of the latent image carrier.

FIG. 11 is a schematic illustration showing another example of the writing head 3, as seen in an axial direction of the latent image carrier 2. In the former example, the rectangular substrate 3*a* is fixed at its end $3a_2$ and is thus set simply to be elastically slightly deflected. In this example, however, a rectangular substrate 3*a* which is made of the same material as the substrate 3*a* of the former example is bent at its center of a direction perpendicular to the axial direction of the latent image carrier 2 into a hair pin curve with a curve top extending along a line of the axial direction of the latent image carrier 2 and the both ends $3a_1$, $3a_2$ of the substrate 3*a* are fixed by a suitable fixing member. In this ease, a conductive mounting plate (shield) 10 is interposed between the both ends $3a_1$ and $3a_2$ of the substrate 3*a* for preventing the crosstalk between two sections of the substrate 3*a* about the curve top, i.e. the upper and lower sections in FIG. 11.

Also in this example, the length of the substrate 3*a* in the axial direction of the latent image carrier 2 is set substantially the same as the axial length of the charged layer 2*d* of the latent image carrier 2 and the substrate 3*a* is provided at a predetermined location of a hair pin curve portion (a curved portion) $3a_3$ with a plurality of writing electrodes 3*b* aligned and fixed in the axial direction of the latent image carrier 2. In a state where the both ends $3a_1$, $3a_2$ of the substrate 3*a* are fixed as shown in FIG. 11, the hair pin curve portion $3a_3$ of the substrate 3*a* is elastically slightly deflected so that the writing electrodes 3*b* are lightly pressed against and in contact with the latent image carrier 2 by the weak elastic restoring force of the hair pin curve portion $3a_3$ of the substrate 3*a*. In the writing head 3 of this example, the substrate 3*a* is supported by the both ends $3a_1$, $3a_2$, thus allowing the writing electrodes 3*b* to be further securely and stably kept in contact with the latent image carrier 2 as compared to the former example. Though drivers 11 for the electrodes 3*b* fixed to the both ends $3a_1$, $3a_2$ of the substrate 3*a*, respectively are shown in FIG. 11, this arrangement corresponds to an array pattern of electrodes shown in FIG. 15 as will be described later.

Figure 12:
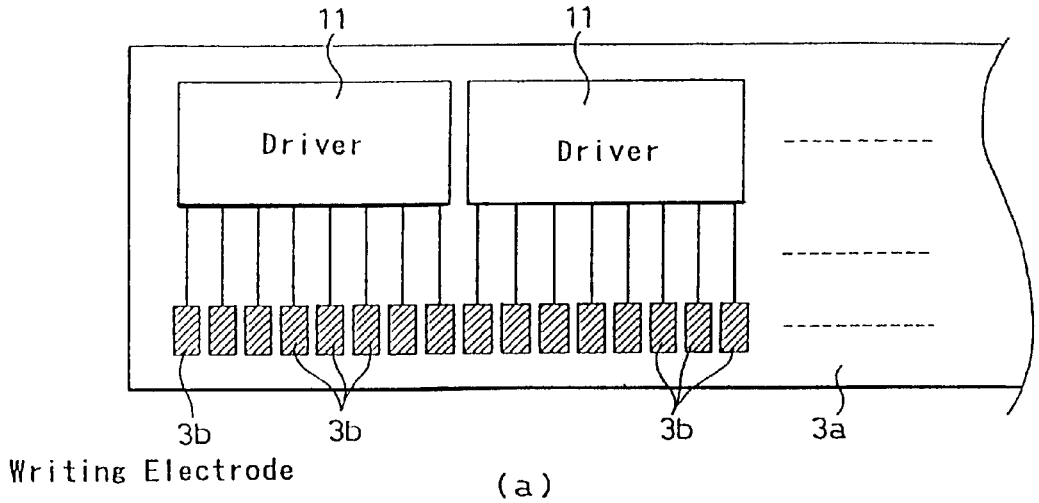
FIG. 12, parts (a)–(c), show array patterns for aligning a plurality of writing electrodes in the axial direction of the latent image carrier, wherein part (a) is a view showing the simplest array pattern for writing electrodes and parts (b) and (c) are views showing array patterns for writing electrodes which achieve to solve problems of the array pattern shown in part (a)
Figure 12:
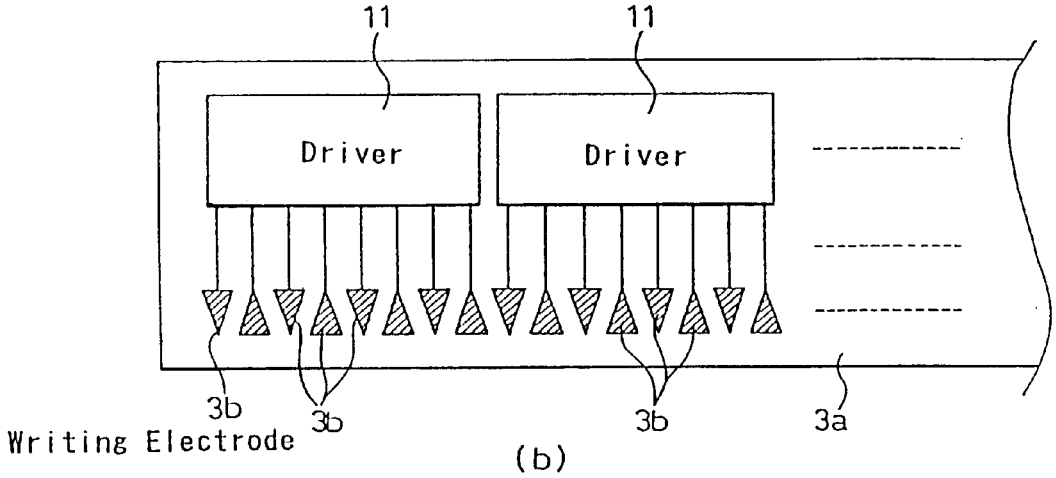
Figure 12:
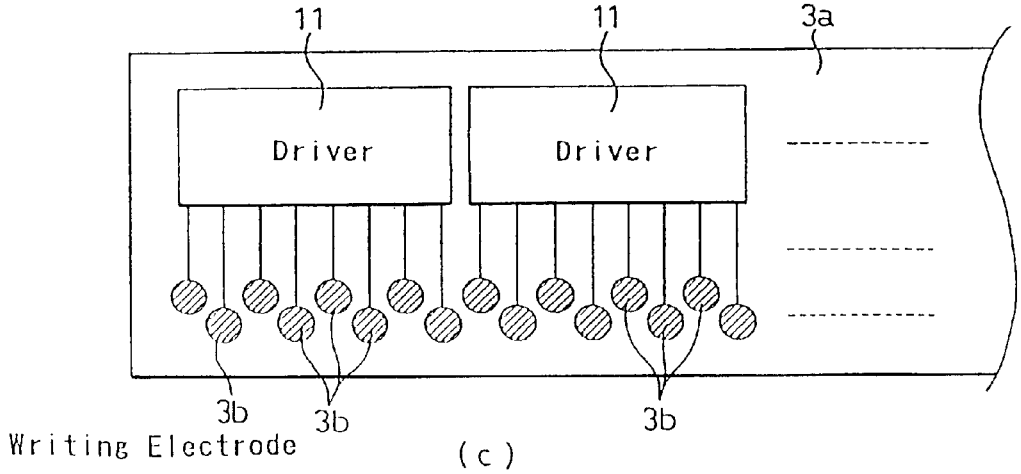

FIGS. 12(*a*)–12(*c*) show array patterns for aligning a plurality of writing electrodes 3*b* in the axial direction of the latent image carrier 2 wherein FIG. 12(*a*) is a view showing the simplest array pattern for writing electrodes and FIGS. 12(*b*) and 12(*c*) are views showing array patterns for writing electrodes which achieve to solve problems of the array pattern shown in FIG. 12(*a*).

In the simplest array pattern (electrode pattern) for the writing electrodes 3*b*, as shown in FIG. 12(*a*), a plurality of rectangular writing electrodes 3*b* are aligned in a row extending in the axial direction of the latent image carrier 2 (main scanning direction) to secure an image formation region. In this case, among the writing electrodes 3*b*, a predetermined number (eight in the illustrated example) of writing electrodes 3*b* are connected to and thus united by a driver 11 which controls the corresponding electrodes 3*b* by switching the supply voltage between the predetermined voltage $V_0$ or the ground voltage $V_1$. Plural units of writing electrodes 3*b* are put in a plurality of lines along the feeding direction and aligned in the same row extending in the axial direction of the latent image carrier 2.

However, when the simple rectangular electrodes 3*b* are simply put aligned in one row extending in the axial direction of the latent image carrier 2 just like this pattern, there should be clearances between adjacent electrodes 3*b*. Portions of the surface of the latent image carrier 2 corresponding to the clearances can not be subjected to the application or removal of charge, leading to an image defect due to linear stains. Therefore, in the array pattern (hereinafter, sometimes referred to as "electrode pattern") for the writing electrodes 3*b* shown in FIG. 12(*b*), the writing electrodes 3*b* are each formed in a triangle and are arranged in such a manner that the orientations of the writing electrodes 3*b* are alternately inverted (that is, one is in the orthographic position while the other one is in the inverted position).

Figure 13:
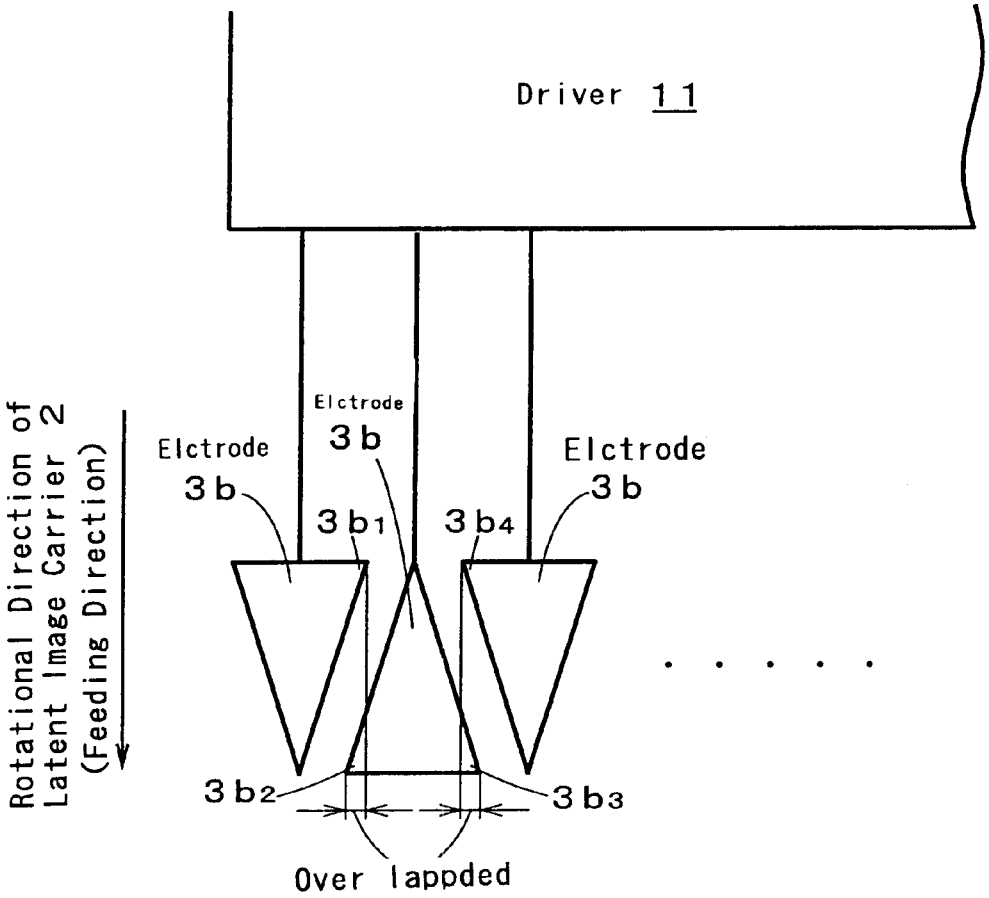
FIG. 13 is a view for explaining the state that adjacent writing electrodes are partially overlapped with each other as seen in the rotational direction of the latent image carrier.

In this case, the writing electrodes 3*b* are arranged such that, as shown in FIG. 13, one end $3b_2$ of the triangle base of one writing electrode 3*b* is overlapped with one end $3b_1$ of the triangle base of a next writing electrode 3*b* on the left of the one writing electrode 3*b*, as seen in the direction perpendicular to the axial direction of the latent image carrier 2 (the rotational direction of the latent image carrier 2; the feeding direction), while the other end $3b_3$ of the triangle base of the one writing electrode 3*b* is overlapped with one end $3b_4$ of the triangle base of the other next writing electrode 3*b* on the right of the one writing electrode 3*b*, as seen in the rotational direction of the latent image carrier 2. The design of partially overlapping adjacent writing electrodes 3*b* in the rotational direction of the latent image carrier 2 can eliminate such portions in the surface of the latent image carrier 2 that are not subjected to the application or removal of charge, thereby achieving application or removal of charge relative to the entire surface of the latent image carrier 2. This design can therefore prevent the occurrence of image defect due to linear stains. Furthermore, foreign matters adhering to the surface of the latent image carrier 2 are allowed to pass through spaces between the adjacent writing electrodes 3*b*, thereby preventing the occurrence of filming due to foreign matters adhering to the writing electrodes 3*b*.

Also in this example, in the same manner as the example shown in FIG. 12(*a*), plural units are each formed by connecting a predetermined number of electrodes 3*b* to one driver 11 and are aligned in one row. It should be noted that, instead of triangle, each electrode 3*b* may be formed in any configuration that allows adjacent electrodes to be partially overlapped with each other as seen in the direction perpendicular to the axial direction of the latent image carrier 2, for example, a trapezoid, a parallelogram, and a configuration having at least one oblique side among sides opposed to adjacent electrodes 3*b*.

In the array pattern for the writing electrodes 3*b* shown in FIG. 12(*c*), the writing electrodes 3*b* are each formed in circle and are aligned in two parallel rows (first and second rows) extending in the axial direction of the latent image carrier in such a manner that the writing electrodes 3*d* are arranged in a zigzag fashion. In this case, the electrodes are arranged such that electrodes which are in different rows but adjacent to each other are partially overlapped with each other as seen in the direction perpendicular to the axial direction of the latent image carrier 2. Also this array pattern can eliminate such portions in the surface of the latent image carrier 2 that are not subjected to the application or removal of charge, thereby achieving application or removal of charge relative to the entire surface of the latent image carrier 2.

Figure 14:
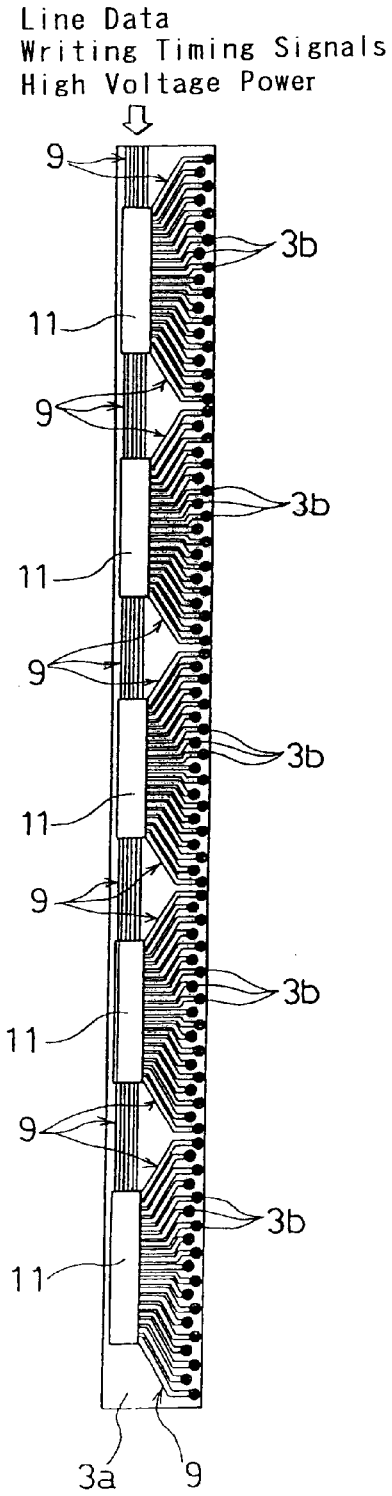
FIG. 14 is a view for illustrating the array pattern for the writing electrodes and the wiring pattern for drivers.
Figure 17:
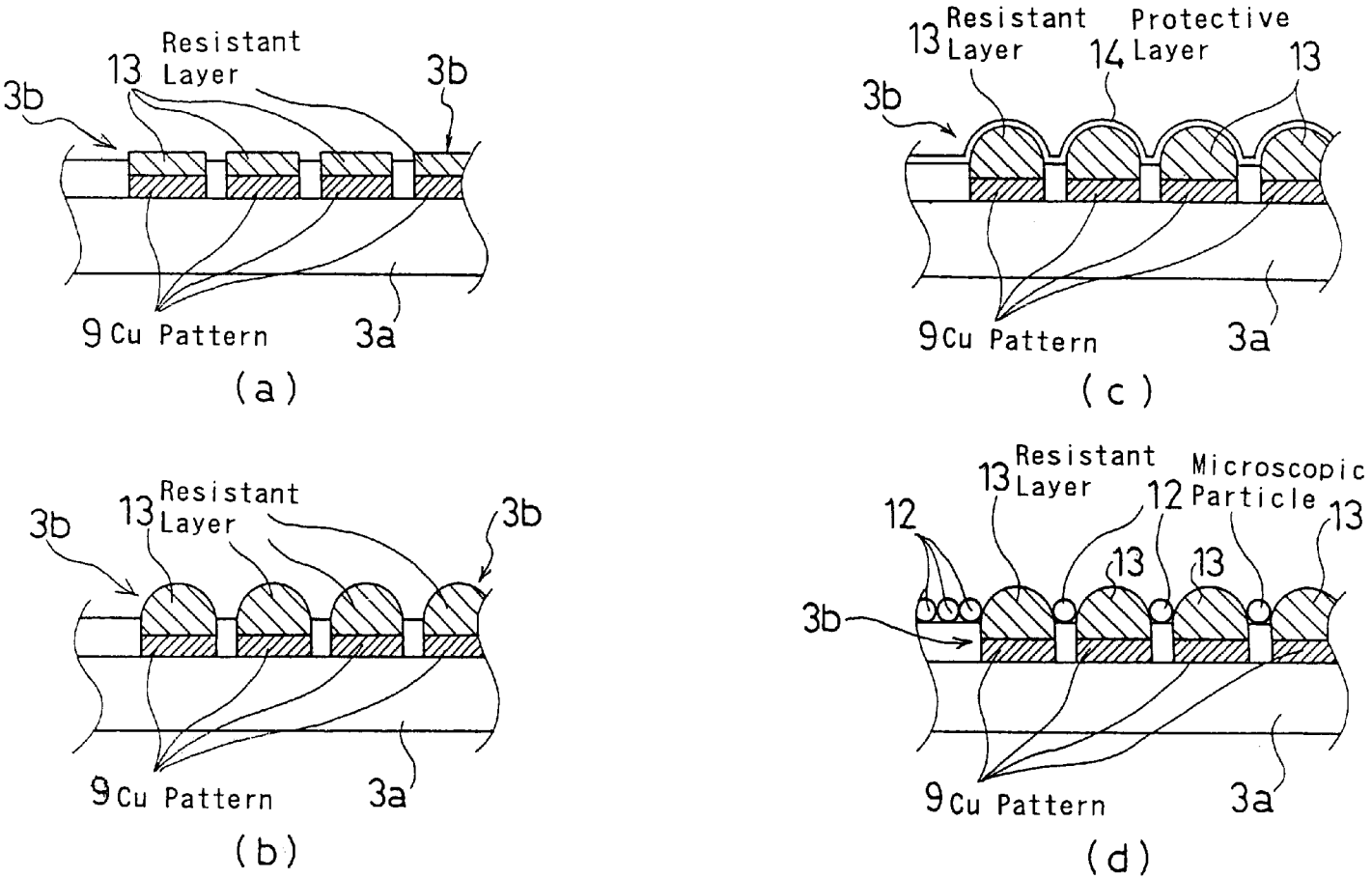
FIG. 17, parts (a)–(d), are sectional views each showing an example of the writing electrodes of the writing device.

In this example, plural units are each formed of a predetermined number of electrodes 3*b* some of which are in the first row and the other are in the second row by connecting these electrodes 3*b* to one driver 11 and are aligned in the axial direction of the latent image carrier 2. The respective drivers 11 are disposed on the same side of the corresponding electrodes 3*b*. As shown in FIG. 14, the respective drivers 11 are electrically connected by conductive patterns (Cu patterns) 9 made of copper (Cu) foil which is formed on the substrate 3*a* and each line of which is formed into a thin flat bar-like shape having a rectangular section (sections are shown in FIGS. 17(*a*)–17(*d*) as will be described later). In the same manner, the drivers 11 are electrically connected to the corresponding electrodes 3*b* by the conductive patterns 9. In addition, the electrodes 3*b* and the drivers 11 are connected to a power source (not shown). The conductive patterns 9 can be formed by a conventional known pattern forming method such as etching.

Line data signals, writing timing signals, and high voltage power are supplied to the respective drivers 11 from the upper side in FIG. 14 so that the drivers 11 controls the corresponding electrodes 3*b* by switching the supply voltage between the predetermined voltage $|V_0|$ and the ground voltage $V_1$ according to the line data signals and the writing timing signals.

Figure 15:
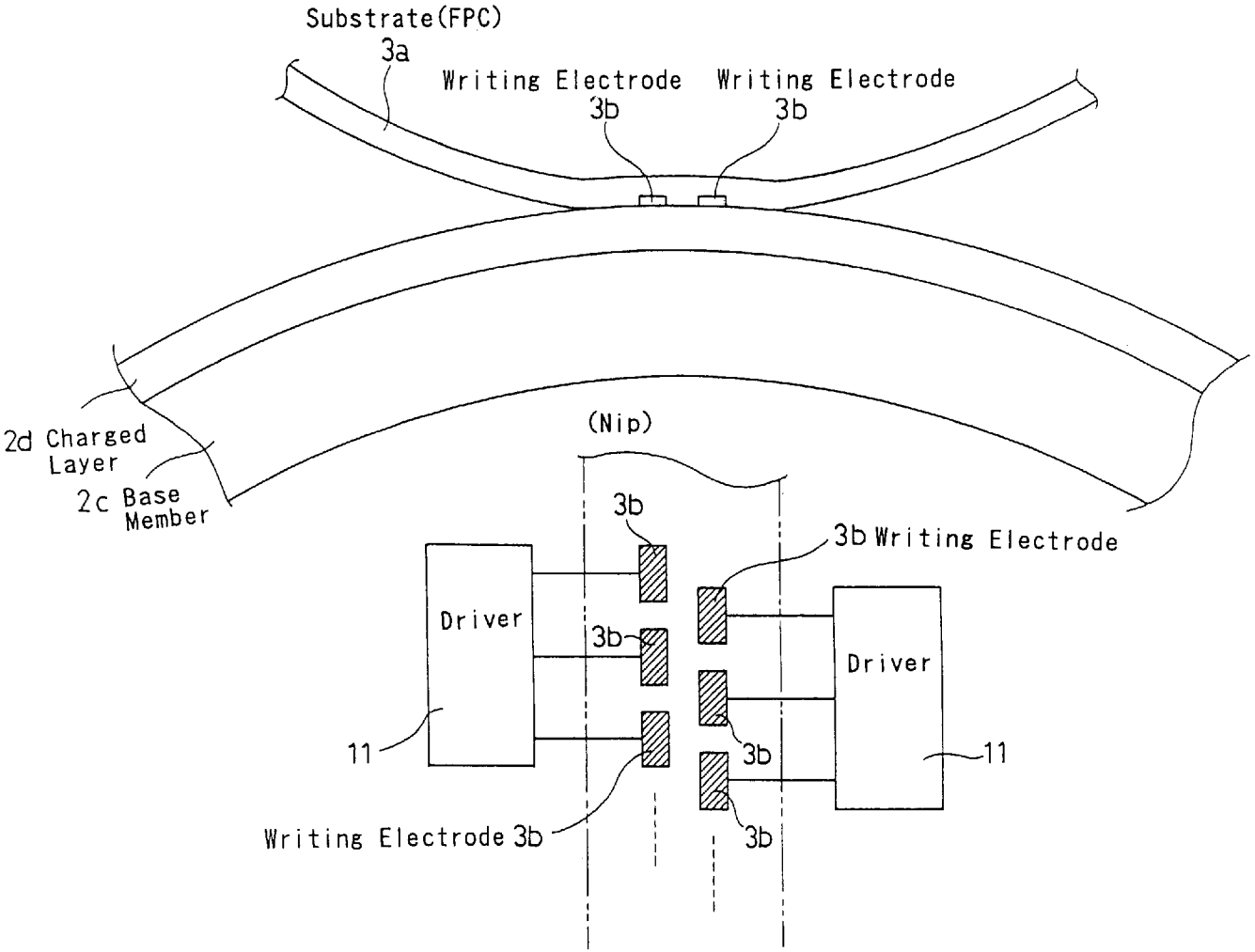
FIG. 15 is a view showing still another example of the array pattern for the writing electrodes.

FIG. 15 is a view showing still another example of the array pattern for the writing electrodes 3*b*.

As shown in FIG. 15, in this array pattern for the writing electrodes 3*b*, the writing electrodes 3*b* are each formed in rectangle. In the same manner as the example shown in FIG. 12(*c*), the writing electrodes 3*b* are aligned in two parallel rows (first and second rows) extending in the axial direction of the latent image carrier 2 in such a manner that the writing electrodes 3*d* are arranged in a zigzag fashion and arranged such that electrodes which are in different rows but adjacent to each other are partially overlapped with each other as seen in the direction perpendicular to the axial direction of the latent image carrier 2. Also this array pattern can eliminate such portions in the surface of the latent image carrier 2 that are not subjected to the application or removal of charge, thereby achieving application or removal of charge relative to the entire surface of the latent image carrier 2. By rounding off the four corners of the rectangle of each writing electrode 3*b*, sharp angled portions (edges) are eliminated, thereby preventing the discharge between adjacent writing electrodes, but not illustrated.

In this example, a predetermined number of electrodes 3*b* in the first row are connected to and united by one driver 11 and a predetermined number of electrodes 3*b* in the second row are connected to and united by another driver 11. For each row, plural units are formed and aligned. The drivers 11 for the electrodes 3*b* in the first row are disposed on the opposite side of the drivers 11 for the electrodes 3*b* in the second row such that these electrodes 3*b* are located therebetween and, as shown in FIG. 11, the opposed drivers 11 are fixed to the both ends $3a_1$, $3a_2$, respectively, of the substrate 3*a* which is bent in a hair pin curve.

It should be understood that the rounding off corners of the writing electrodes is not limited to rectangular electrodes and may be applied to triangular electrodes and other polygonal electrodes.

Figure 16:
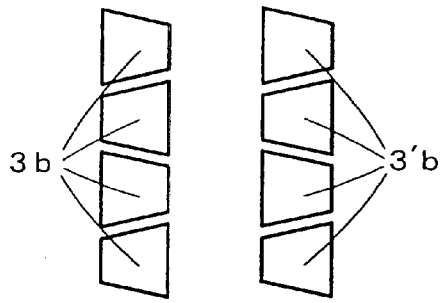
FIG. 16, parts (a)–(d), are views showing still another examples of the array pattern for the writing electrodes.
Figure 16:
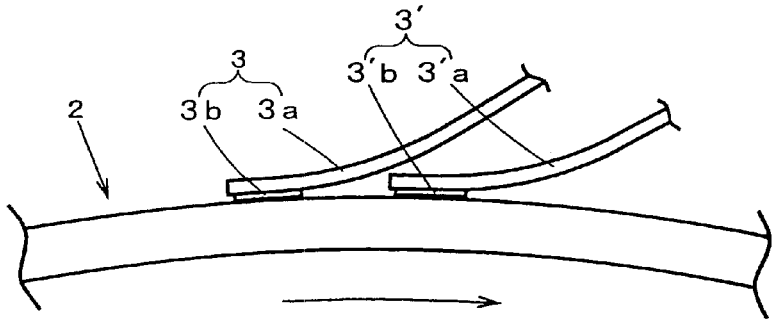
Figure 16:
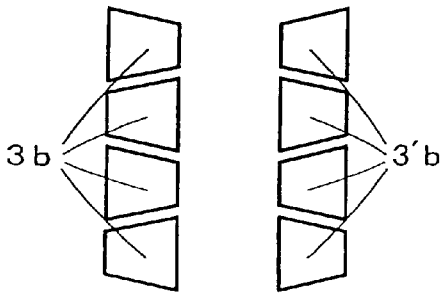
Figure 16:
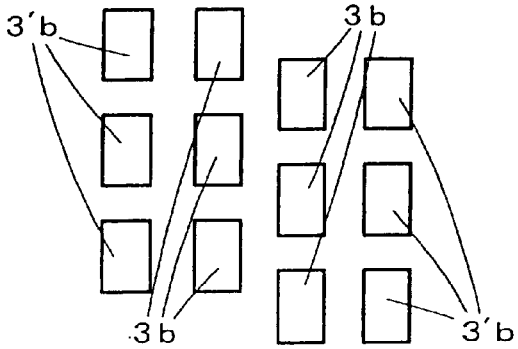

FIGS. 16(*a*)–16(*d*) are views showing still another examples of the array pattern for the writing electrodes 3*b*.

In any of the array patterns for the writing electrodes 3*b* of the aforementioned examples shown in FIG. 12(*c*) and FIG. 15, the writing electrodes 3*b* are aligned in two parallel rows extending in the axial direction of the latent image carrier 2 in such a manner that the writing electrodes 3*d* are arranged in a zigzag fashion. In the array pattern for the writing electrodes 3*b* of an example shown in FIGS. 16(*a*) and 16(*b*), however, writing electrodes 3*b* are aligned in two rows (first and second rows) which are completely identical to each other and spaced at a predetermined distance in the direction perpendicular to the axial direction of the latent image carrier 2, wherein the first row consists of writing electrodes 3*b* which are, for example, trapezoidal and the second row consists of writing electrodes 3'*b* corresponding to the writing electrodes 3*b* of the first row. That is, two identical writing electrodes 3*b*, 3'*b* are arranged in a line along the direction perpendicular to the axial direction of the latent image carrier 2. This design achieves further secured and stable application of charge relative to the charged layer 2*d* of the latent image carrier 2. It should be noted that, in the same manner as the example shown in FIG. 12(*b*), opposed oblique sides of adjacent trapezoidal electrodes 3*b* or 3'*b* in the same row are partially overlapped with each other as seen in the direction perpendicular to the axial direction of the latent image carrier 2.

In the array pattern of an example shown in FIG. 16(*c*), the trapezoids of the writing electrodes 3*b* in the first row are mirror images of those of the writing electrodes 3'*b* in the second row in the example shown in FIG. 16(*b*). The array pattern of an example shown in FIG. 16(*d*) is similar to that shown in FIG. 15, but additional writing electrodes 3'*b* are aligned in two additional rows each of which is arranged adjacent to each of the original rows, of which writing electrodes 3*b* are arranged in zigzag fashion shown in FIG. 15, wherein the original and additional rows are parallel and extend in the axial direction of the latent image carrier 2 and writing electrodes 3'*b* in each additional row are identical and correspond to those in the adjacent original row, so that two identical writing electrodes 3*b*, 3'*b* are arranged in a line along the direction perpendicular to the axial direction of the latent image carrier 2. The actions and effects of these examples are equal to those of the example shown in FIG. 16(*a*).

FIGS. 17(*a*)–17(*d*) are sectional views each showing an example of the writing electrodes 3*b* of the writing head 3. In the drawings for the aforementioned examples, the writing electrodes 3*b* of the writing head 3 are illustrated with their contact portions to the latent image carrier 2 facing downward. In FIGS. 17(*a*)–17(*d*), however, the writing electrodes 3*b* are illustrated with their contact portions to the latent image carrier 2 facing upward.

In the writing head 3 of an example shown in FIG. 17(*a*), a resistant layer 13 having a rectangular section is formed on each electrode forming portion of the surface of the conductive pattern (Cu pattern) 9 formed on the substrate 3*a* so as to form each writing electrode 3*b* having double layered structure. The resistant layer 13 can be formed by a conventional known coating method, for example by using an inkjet printer. Another known coating means may be employed instead of the inkjet printer. In case of using an inkjet printer, the thickness of the resistant layer 13 can be controlled with high precision, thereby achieving further accurate control of charge on the latent image carrier 2. When the resistance of the resistant layer 13 is relatively small, the application or removal of charge is dominated by the charge-transfer between the writing electrodes 3*b* and the latent image carrier 2. On the other hand, when the resistance of the resistant layer 13 is relatively large, the application or removal of charge is dominated by the discharge between the writing electrodes 3*b* and the latent image carrier 2.

When the resistance value of the writing electrode 3*b* is set at $10^8\Omega$ cm or less, a predetermined time constant can be ensured, thus achieving uniform charge. On the other hand, when the resistance value of the writing electrode 3*b* is set at $10^6\Omega$ cm or more, the electrostatic breakdown due to pin holes of the charged layer 2*d* of the latent image carrier 2 can be prevented. Therefore, it is preferable that the resistance value of the resistant layer 13 of the writing electrode 3*b* is set in a range from $10^6\Omega$ cm to $10^8\Omega$ cm.

The writing electrode 3*b* of this example is designed such that the surface of the resistant layer 13 is in plane contact with the charged layer 2*d* of the latent image carrier 2. The function of the resistant layer 13 of the writing electrode 3*b* provided on the conductive pattern 9 prevents the broadening of the charge-transfer in the lateral direction. This achieves effective charge-transfer between the writing electrode 3*b* and the latent image carrier 2. It should be noted that the resistant layer 13 is not limited to be formed to have a rectangular section as shown in FIG. 17(*a*) and thus may be formed in a half-cylindrical configuration having a semi-circular section which projects upwardly in FIG. 17(*a*) and of which axial direction is parallel to the direction perpendicular to the axial direction of the latent image carrier 2. In case of the resistant layer 13 having this half-cylindrical configuration, the resistant layer 13 should be in line contact with the charged layer 2*d* of the latent image carrier 2 along the direction perpendicular to the axial direction of the latent image carrier 2. It should be noted that this line contact may be inclined against the direction perpendicular to the axial direction of the latent image carrier 2.

In the writing head 3 of an example shown in FIG. 17(*b*), the resistant layer 13 of the electrode 3*b* is formed substantially in a semi-circular convex shape projecting upwardly, instead of the shape having a rectangular section of the aforementioned example shown in FIG. 17(*a*). That is, the writing electrode 3*b* has a convexity projecting toward the latent image carrier 2. Therefore, the top of the resistant layer 13 is a spherical surface so that the resistant layer 13 is in point contact with the charged layer 2*d* of the latent image carrier 2 so that the surface of the writing electrode 3*b* is not entirely in contact with the latent image carrier 2. According to this structure, charge-transfer is conducted at the point contact portion between the resistant layer 13 and the charged layer 2*d* and charge-transfer due to charge leak is also conducted around the point contact portion, whereby application or removal of charge relative to the charged layer 2*d* can be conducted via the charge-transfer. Since the surface of the resistant layer 13 is spherical, discharge is conducted at location around and near the point contact portion between the resistant layer 13 and the charged layer 2*d*. Therefore, application or removal of charge relative to the charged layer 2*d* can be conducted also via the discharge. Further, this discharge can achieve application or removal of charge relative to the charged layer 2*d* without formation of portions, as mentioned above, in the charged layer 2*d* which are not subjected to the application or removal of charge. Furthermore, because of point contacts, foreign matters adhering to the surface of the latent image carrier 2 are allowed to pass, thereby preventing the occurrence of filming on the surface of the latent image carrier 2. Still further, since the resistant layer 13 is made of material easily to wear, the resistant layer 13 is shaved by contact of the surface of the resistant layer 13 of the writing electrodes 3*b* relative to the latent image carrier 2, whereby the resistant layer 13 of the writing electrode 3*b* can have a fresh surface. In this manner, by making the portion of the writing electrode 3*b* confronting the latent image carrier 2 from material easily to wear, the surface of the writing electrode 3*b* can be kept fresh, thus preventing the filming.

In the writing head 3 of an example shown in FIG. 17(*c*), a protective layer 14 is formed as an overcoat on the spherical tops of the resistant layers 13 as the example shown in FIG. 17(*b*) and the surface of the substrate 3*a*. This protective layer 14 makes the surfaces of the resistant layers 13 hard to wear and hard to be adhered with foreign matters.

In the writing head 3 of an example shown in FIG. 17(*d*), a large number of microscopic spherical particles 12 are arranged to be freely roll on the surface of the substrate 3*a* supporting the writing electrodes 3*b* with the resistant layers 13 each having a spherical top as the example shown in FIG. 17(*b*), facilitating passing of foreign matters. With the aid of the microscopic particles 12, foreign matters can easily pass between the writing electrodes 3*b* and the latent image carrier 2 and improved lubrication can be obtained between the writing electrodes 3*b* and the foreign matters, thereby preventing adhering of foreign matters to the writing electrodes 3*b*. The particle size of the microscopic particles 12 is normally set to have a diameter widely smaller than the particle diameter of toner (developing powder). Because the particle diameter of toner is normally about 10 $\mu$m, the microscopic particles 12 are set to have a very small diameter of 1 $\mu$m or less. The microscopic particles 12 are made of transparent resin such as acrylic resin. Since the microscopic particles 12 are made of transparent resin, the microscopic particles 12 never affect the image portions even if the particles 12 move to the image portions.

The microscopic particles 12 are supplied to both the substrate 3*a* and the writing electrodes 3*b*, only to the writing electrodes 3*b*, or to other locations than the writing electrodes 3*b*. When the microscopic particles 12 are supplied to the both, lubricity between the substrate 3*a*, the writing electrodes 3*b* and the latent image carrier 2 is improved. When the microscopic particles 12 are supplied only to the writing electrodes 3*b*, the gap between the writing electrodes 3*b* and the latent image carrier 2 can be kept constant so as to improve the discharge. When the microscopic particles 12 are supplied to other locations than the writing electrodes 3*b*, the charge-transfer is conducted by the writing electrodes 3*b* and lubricity at the locations supplied with the microscopic particles 12 is improved.

Figure 18:
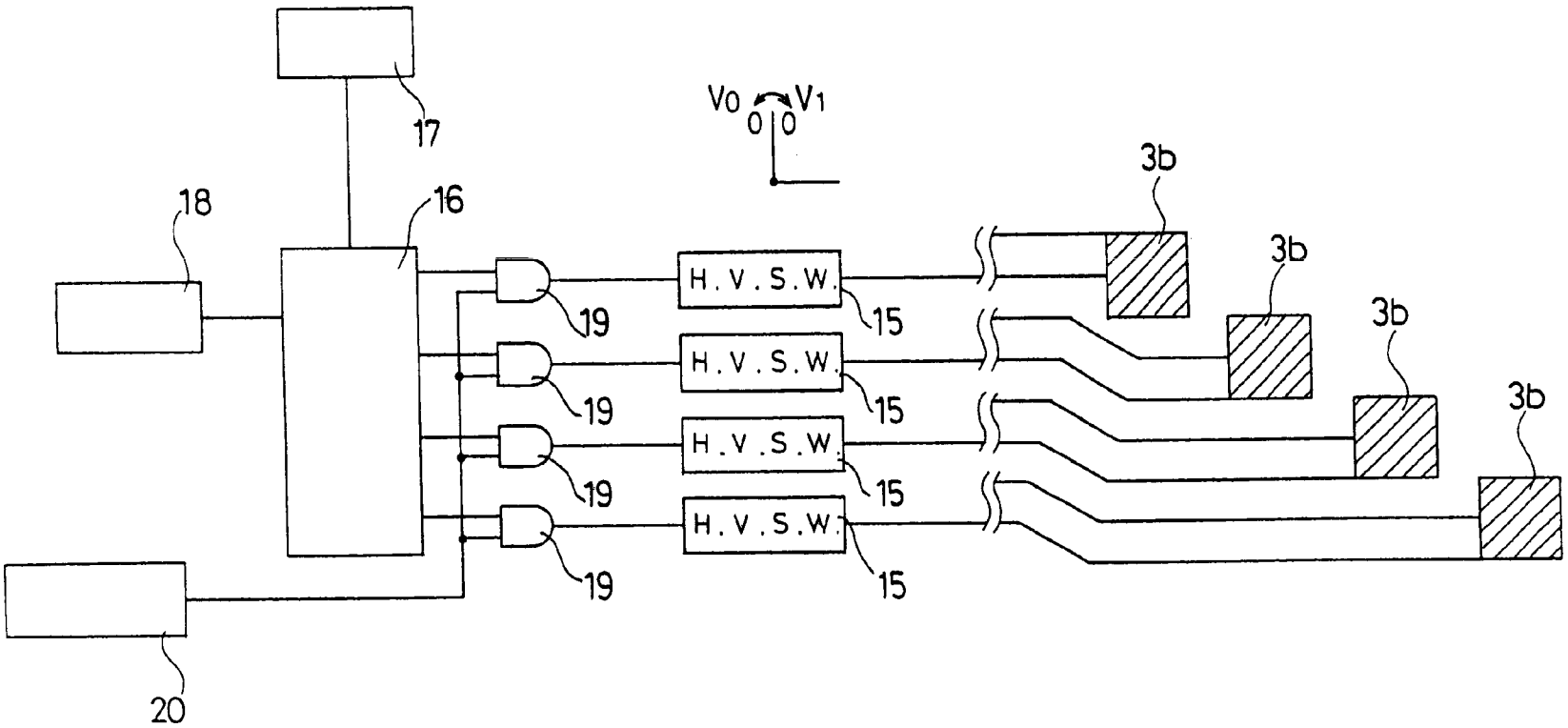
FIG. 18 is a diagram showing a switching circuit for switching the voltage to be supplied to the writing electrodes between the predetermined voltage $V_0$ and the ground voltage $V_1$.

FIG. 18 is a diagram showing a switching circuit for switching the voltage to be connected to the writing electrodes 3*b* between the predetermined voltage $V_0$ and the ground voltage $V_1$.

As shown in FIG. 18, the writing electrodes 3*b* which is arranged, for example, in four lines are connected to corresponding high voltage switches (H.V.S.W.) 15, respectively. Each of the high voltage switches 15 can switch the voltage to be supplied to the corresponding electrode 3*b* between the predetermined voltage $V_0$ and the ground voltage $V_1$. An image writing control signal is inputted into each high voltage switch 15 from a shift resistor (S.R.) 16, to which an image signal stored in a buffer 17 and a clock signal from a clock 18 are inputted. The image writing control signal from the shift resistor is inputted into each high voltage switch 15 through each AND circuit 19 in accordance with a writing timing signal from an encoder 20. The high voltage switches 15 and the AND circuits 19 cooperate together to form the aforementioned driver 11 which controls the supply voltage for the corresponding electrodes 3*b*.

Figure 19:
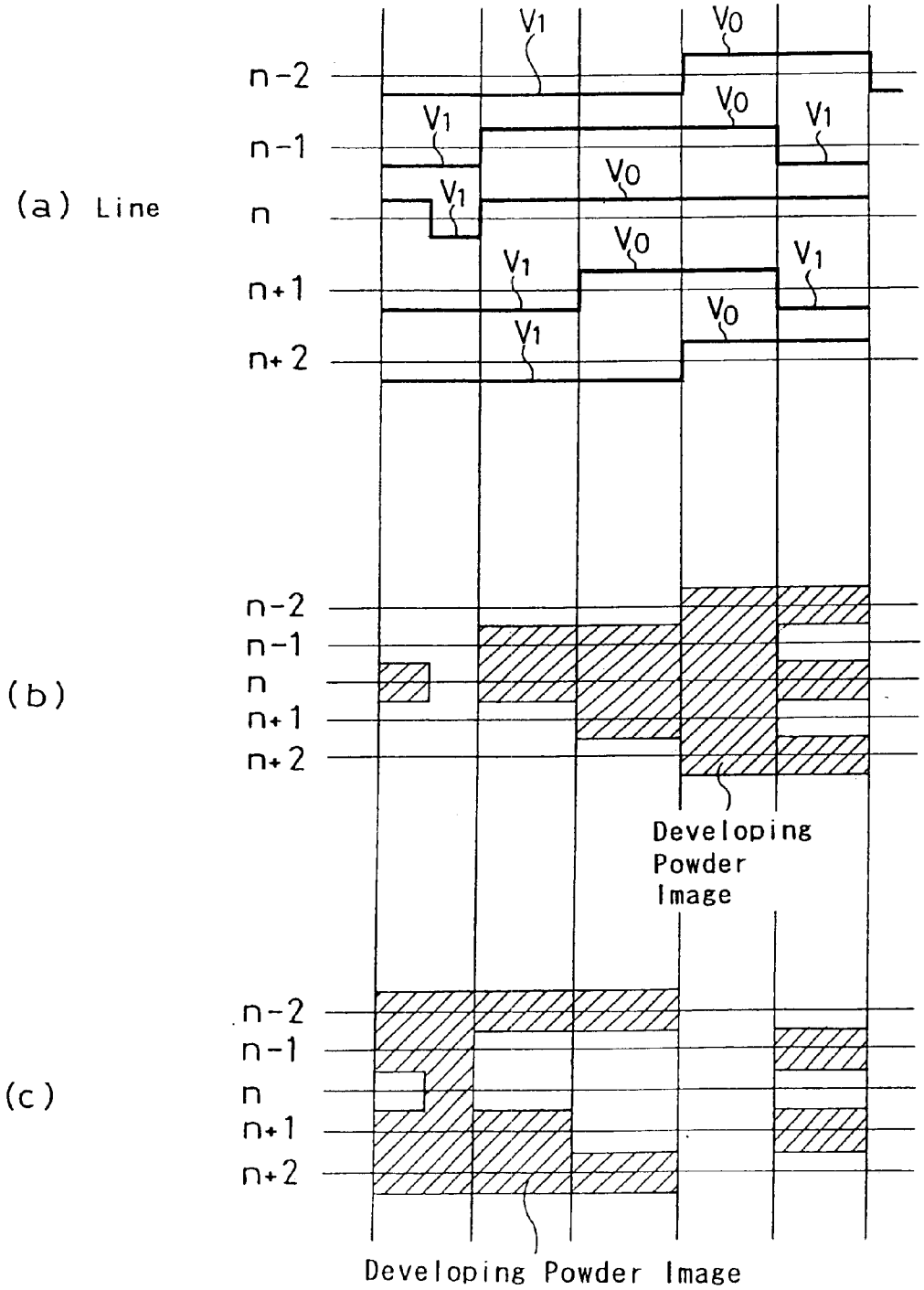
FIG. 19, parts (a)–(c) show profiles when the supply voltage for each electrode is selectively controlled into the predetermined voltage $V_0$ or the ground voltage $V_1$ by switching operation of the corresponding high voltage switch, wherein part (a) is a diagram showing the voltage profiles of the respective electrodes, part (b) is a diagram showing a developing powder image obtained by normal developing with the voltage profiles shown in part (a), and part (c) is a diagram showing a developing powder image obtained by reverse developing with the voltage profiles shown in part (a)

FIGS. 19(*a*)–19(*c*) show profiles when the supply voltage for each electrode 3*b* is selectively controlled into the predetermined voltage $V_0$ or the ground voltage $V_1$ by switching operation of the corresponding high voltage switch 15, wherein FIG. 19(*a*) is a diagram showing the voltage profiles of the respective electrodes, FIG. 19(*b*) is a diagram showing a developing powder image obtained by normal developing with the voltage profiles shown in FIG. 19(*a*), and FIG. 19(*c*) is a diagram showing a developing powder image obtained by reverse developing with the voltage profiles shown in FIG. 19(*a*).

Assuming that the electrodes 3*b*, for example as shown in FIGS. 19(*a*)–19(*c*), five electrodes indicated by n−2, n−1, n, n+1, and n+2, respectively, are controlled to be into the voltage profiles shown in FIG. 19(*a*) by switching operation of the respective high voltage switches 15. When an electrostatic latent image is written on the latent image carrier 2 with the electrodes 3*b* having the aforementioned voltage profiles and is then developed normally, the developing powder 8 adheres to portions at the predetermined voltage $V_0$ of the latent image carrier 2, thereby obtaining a developing powder image as shown by hatched portions in FIG. 19(*b*). When an electrostatic latent image is written in the same manner and is then developed reversely, the developing powder 8 adheres to portions at the ground voltage $V_1$ of the latent image carrier 2, thereby obtaining a developing powder image as shown by hatched portions in FIG. 19(*c*).

According to the image forming apparatus 1 employing the writing head 3 having the aforementioned structure, since the convexities of the writing electrodes 3*d* are in contact with the latent image carrier 2 so that the surface of the writing electrode 3*b* is not entirely in contact with the latent image carrier 2, foreign matters adhering to the surface of the latent image carrier 2 are allowed to pass, thereby preventing the occurrence of filming on the surface of the latent image carrier 2.

In addition, the writing electrodes 3*b* are supported by the flexible substrate 3*a*, thereby stabilizing the positions of the writing electrodes 3*b* relative to the latent image carrier 2 and thus stably and reliably conducting the application or removal of charge by the writing electrodes 3*b* relative to the latent image carrier 2. Therefore, stable writing of an electrostatic latent image onto the latent image carrier 2 is achieved, thus reliably obtaining a high quality image with high precision.

Since the writing electrodes 3*b* can be kept in contact with the latent image carrier 2 with a small pressing force by the flexible substrate 3*a*, the gap (space) between the writing electrodes 3*b* and the latent image carrier 2 can be eliminated. No gap practically reduces the possibility that air existing in the gap is undesirably ionized, thereby further reducing the generation of ozone and enabling the formation of an electrostatic latent image with low potential.

Since the convexity of the writing electrode is allowed to be formed in various configurations, the writing electrode is flexible to be employed in various types of image forming apparatus. In particular, when the convexity of the writing electrode 3*b* is formed in a portion of sphere, a cone, an elliptic cone, an oval cone, a triangle pyramid, a square pyramid, or a polygonal pyramid having five corners or more, the writing electrode 3*b* and the latent image carrier 2 are in point contact, thereby further securely allowing foreign matters adhering to the surface of the latent image carrier 2 to pass through. When the convexity of the writing electrode 3*b* is formed in a circular column, a truncated cone, an elliptic column, a truncated elliptic cone, an oval column, a truncated oval cone, a triangle column, a truncated triangle pyramid, a square column of which cross section is a parallelogram or a trapezoid, a truncated square pyramid of which cross section is a parallelogram or a trapezoid, a polygonal column (having five corners or more), a polygonal pyramid (having five corners or more), and a truncated polygonal pyramid (having five corners or more), the writing electrode 3*b* has side faces inclined against the feeding direction, whereby foreign matters adhering to the surface of the latent image carrier 2 can easily pass through because the foreign matters easily slide along the inclined faces.

Since the writing electrodes 3*b* are in contact with the latent image carrier 2 by a small pressing force, the latent image carrier 2 can be prevented from being damaged by the writing electrodes 3*b*, thus improving the durability of the latent image carrier 2.

Further, since the writing head 3 employs only the writing electrodes 3*b* without using a laser beam generating device or a LED light generating device which is large in size as conventionally used, the apparatus size can be reduced and the number of parts can also be reduced, thereby obtaining an image forming apparatus which is simple and low-price.

Furthermore, since the resistant layer 13 of the writing electrode 3*b* is made of material easily to wear, the surface of the resistant layer 13 of the writing electrode 3*b* should wear to have a fresh surface so that the surface of the writing electrode can be kept fresh, thus preventing the filming of the writing electrode 3*b*.

Every pair of writing electrodes 3*b* which are next to each other are partially overlapped with each other as seen in the feeding direction of the latent image carrier 2, thereby eliminating such portions in the surface of the latent image carrier that are not subjected to the application or removal of charge and thus achieving application or removal of charge relative to the entire surface of the latent image carrier 2. Therefore, the occurrence of image defect of linear stains due to spaces between the adjacent electrodes 3*b* can be prevented.

By rounding off the corners of a polygon of each writing electrode 3*b*, sharp angled portions (edges) are eliminated, thereby preventing the discharge between adjacent writing electrodes.

Moreover, the substrate 3*a* and the writing electrodes 3*b* are coated with the protective layers 14, 29. The protective layers 14, 29 prevent wear of the writing electrodes 3*b* and prevent foreign matters from adhering to the writing electrodes 3*b*. It should be noted that, according to the present invention, it is not necessary to coat both of the substrate 3*a* and the writing electrodes 3*b* with the protective layers 14, 29 and it is enough to coat at least the writing electrodes 3*b* with the protective layers 14, 29.

In addition, since the resistant layer 13 is made of material easily to wear, the resistant layer 13 is shaved by contact the surface of the resistant layer 13 of the writing electrodes 3*b* relative to the latent image carrier 2, whereby the resistant layer 13 of the writing electrode 3*b* can have a fresh surface. In this manner, by making the portion of the writing electrode confronting the latent image carrier from material easily to wear, the surface of the writing electrode can be kept fresh, thus preventing the filming.

Figure 20:
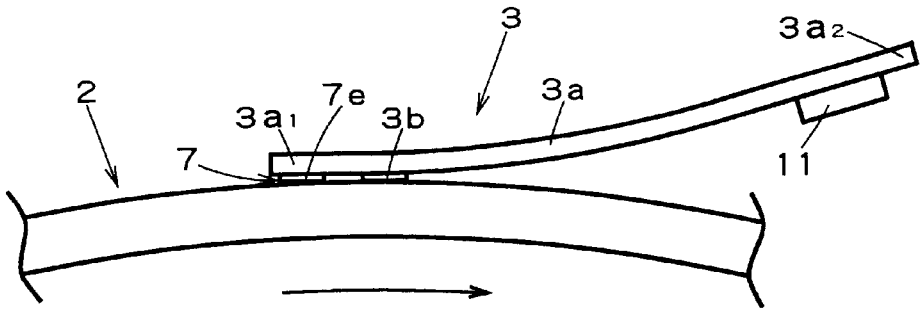
FIG. 20 is a view similar to FIG. 5 but schematically and partially showing another example of the image forming apparatus according to the present invention.

FIG. 20 is a view similar to FIG. 5 but schematically and partially showing another example of the image forming apparatus according to the present invention.

In any of the aforementioned examples, the charge control device 7 for uniformly charging the latent image carrier 2 is provided separately from the writing head 3. In the image forming apparatus 1 of this example, the charge control device 7 is disposed on the substrate 3*a* of the writing head 3 as well as the writing electrodes 3*a* as shown in FIG. 20. That is, a uniformly charging electrode 7*e* of the charge control device 7 is disposed on the end $3a_1$ of the substrate 3*a* of the writing head 3 in such a manner that the writing electrodes 3*b* are spaced apart from the uniformly charging electrode 7*e* at a predetermined gap. In this case, the uniformly charging electrode 7*e* is formed into a thin plate-like shape having a rectangular section. The uniformly charging electrode 7*e* is continuously disposed to extend in the axial direction of the latent image carrier 2 along the same length as the axial length of the charged layer 2*d* of the latent image carrier 2. The writing electrodes 3*b* and the uniformly charging electrode 7 are kept in contact with the surface of the latent image carrier 2 with a small pressing force by weak elastic restoring force created by deflection of the substrate 3*a*.

In the image forming apparatus 1 of this example having the aforementioned structure, after the surface of the latent image carrier 2 is uniformly charged by the uniformly charging electrode 7*e* on the end $3a_1$ of the substrate 3*a*, the writing electrodes 3*b* write an electrostatic latent image on the surface of the latent image carrier 2 by applying charge to or removing charge from selected areas of the surface of the latent image carrier 2 through charge-transfer of the writing electrodes 3*b*.

In the image forming apparatus of this example, the uniformly charging electrode 7*e* and the writing electrodes 3*b* are disposed together, thereby allowing the manufacture of an image forming apparatus 1 which is smaller in size and simpler in structure. The other structures, actions, and effects of the image forming apparatus 1 of this example are the same as those of the example shown in FIG. 5.

It should be understood that the design of providing the uniformly charging electrode 7*e* and the writing electrodes 3*b* as one unit is not limited to the illustrated example shown in FIG. 20, may be applied to any of the image forming apparatuses of the aforementioned examples and, in addition, any case applied with this design can exhibit the same works and effects. A suitable insulator may be arranged in the gap between the writing electrodes 3*b* and the uniformly charging electrode 7*e*.

Figure 21:
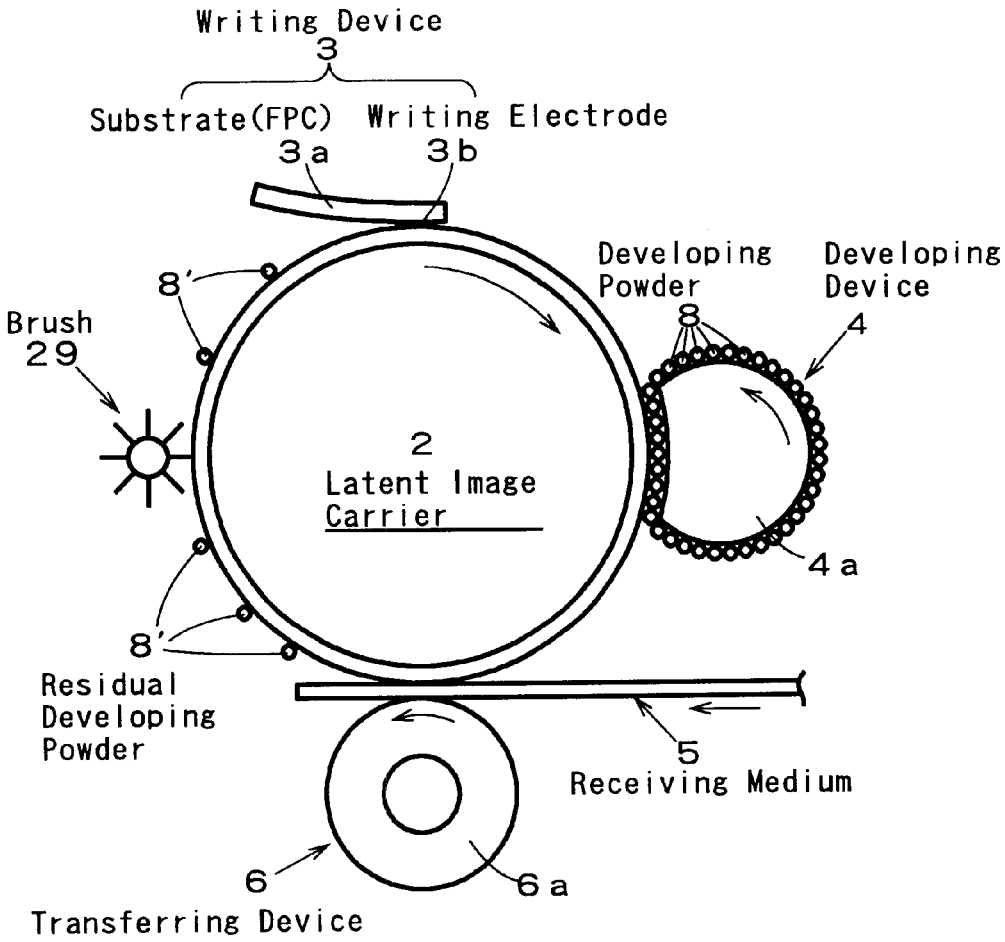
FIG. 21 is a view schematically showing an example of an image forming apparatus employing the writing device of the present invention.

FIG. 21 is a view schematically showing a concrete example of an image forming apparatus employing the writing device of the present invention.

As shown in FIG. 21, an image forming apparatus 1 as a concrete example of which a writing head 3 comprising a substrate 3*a* extending from the upstream toward the downstream in the rotational direction of a latent image carrier 2, and writing electrodes 3*b* which are fixed to the end of the substrate 3*a* and are arranged in contact with the latent image carrier 2. In the image forming apparatus 1 of this example, a developing roller 4*a* of a developing device 4 is in contact with the latent image carrier 2 to perform contact developing.

Disposed on the downstream side of a transferring device 6 in the rotational direction of the latent image carrier 2 is a brush 29. Residual developing powder 8' on the latent image carrier 2 after the former transfer of a latent image is dispersed to be homogenized by the brush 29.

In the image forming apparatus 1 of this concrete example having the aforementioned structure, after the surface of the latent image carrier 2 is made into the uniformly charged state by a charge control device 7 (not shown), the writing head 3 writes an electrostatic latent image on the surface of the latent image carrier 2 by applying charge to or removing charge from the surface of the latent image carrier 2 through the writing electrodes 3*b* of the writing head 3. The developing device 4 develops the latent image on the latent image carrier 2 to form a developing powder image by bringing developing powder to adhere to the wrote latent image through the developing roller 4*a* of the developing device 4. Then, the transferring device 6 transfers the developing powder image on the latent image carrier 2 to a receiving medium 5. Residual developing powder 8' on the latent image carrier 2 after the transfer is dispersed to be homogenized on the latent image carrier 2 by the brush 29. In the next uniformly charging process, the surface of the latent image carrier 2 and the residual developing powder 8' are made into the uniformly charged state by the charge control device 7. Then, the writing electrodes 3*b* of the writing head 3 write an electrostatic latent image on the surface of the latent image carrier 2 and on the residual developing powder 8'.

By the developing device 4, the electrostatic latent image is developed. During this, by selectively charging the writing electrodes 3*b* to have the same polarity as the original polarity of the residual developing powder 8', residual developing powder 8' on non-image portions of the latent image carrier 2 is charged into the polarity by the writing electrodes 3*b* so as to move toward the developing roller 4*a* of the developing device 4, while residual developing powder 8' on image portions of the latent image carrier 2 still remains on the latent image carrier 2 as developing powder for subsequent developing. By transferring the residual developing powder on the non-image portions toward the developing roller 4*a*, the surface of the latent image carrier 2 can be cleaned even without a device for cleaning the latent image carrier 2. That is, the image forming apparatus 1 of this example is designed to form an image in the cleaner-less cleaning method in which the developing process and the cleaning process are simultaneously conducted.

Description will now be made as regard to as the cleaner-less cleaning method.

Figure 22:
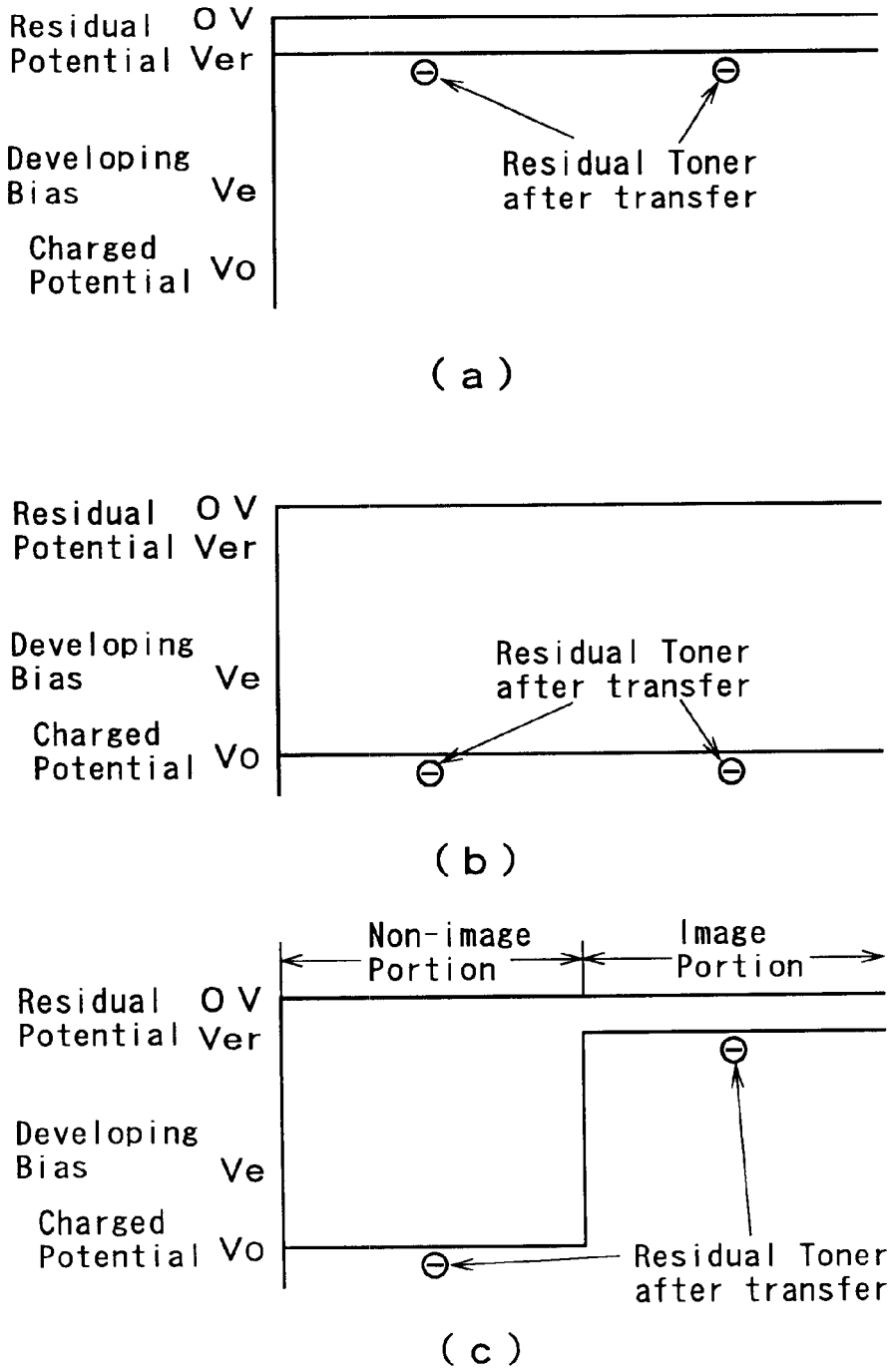
FIG. 22, part (a)–(c), are views for explaining parts of the cleaner-less cleaning method employing reverse developing.
Figure 23:
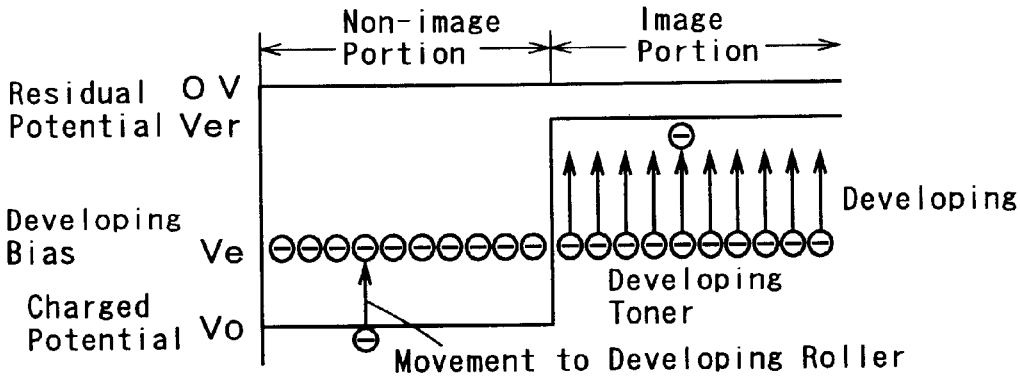
FIG. 23, part (a)–(c), are views for explaining the other parts of the cleaner-less cleaning method employing reverse developing.
Figure 23:
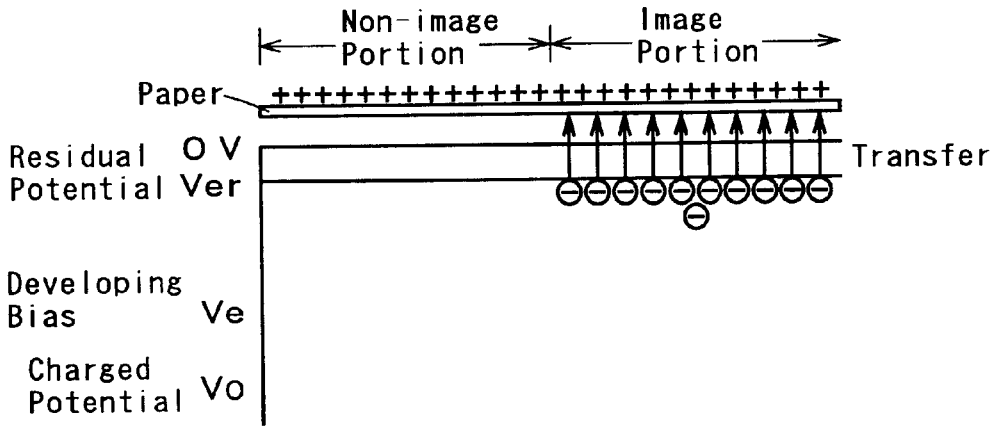
Figure 23:
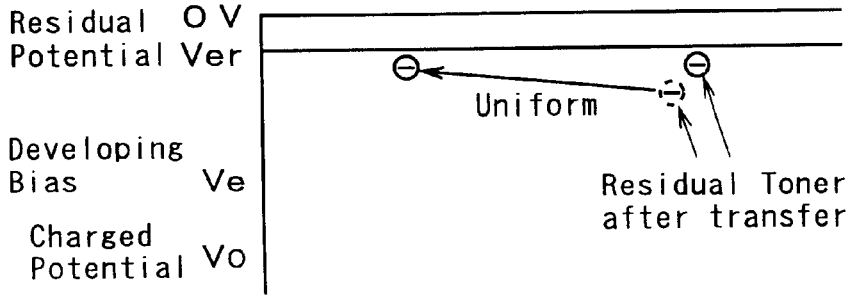

FIGS. 22(*a*)–22(*c*) and FIGS. 23(*a*)–23(*c*) are views for explaining the cleaner-less cleaning method employing reverse developing.

This cleaning method will be described with reference to a case of the image forming process shown in FIG. 2(*g*). It should be understood that this description is for illustrative purpose and this cleaner-less cleaning method may be applied to other image forming processes employing the reverse developing.

As shown in FIG. 22(*a*), residual toner (the aforementioned residual developing powder 8') are adhering to the photoreceptor 2*a* after transfer for the former image forming process. Generally, the potentials Ver of the residual toner particles (hereinafter, residual potential Ver) are not in the same polarity. That is, there are positively charged particles and negatively charged particles (only negatively charged particles are shown). In this state, as shown in FIG. 22(*b*), the photoreceptor 2*a* is uniformly charged into a negatively charged potential $V_0$ by the charge control roller 7*c* so that the photoreceptor 2*a* is homogenized to have charge of a negative polarity. At the same time of negatively charging the photoreceptor 2*a*, all of particles of the residual toner are also uniformed into charge potential $V_0$ of the negative polarity. The negatively charged particles of the residual toner have the same polarity as that of the developing toner carried by the developing roller 4*a*. In other words, the residual toner is charged to have the negative polarity which is equal to the original polarity thereof.

As shown in FIG. 22(*c*), an electrostatic latent image is written on the latent image carrier 2 by removing charge from image portions of the latent image carrier 2 through the writing electrodes 3*b* (that is, changing the image portions from the residual potential Ver to a potential nearly 0V (zero volt)). At this point, the residual toner particles exist both on the image portions and on the non-image portions.

As shown in FIG. 23(*a*), developing toner is supplied by the developing device 4 and adhere to portions of the latent image carrier 2 of which surface potential is attenuated by the writing of the writing electrodes 3*b*, whereby the electrostatic latent image on the latent image carrier 2 is developed by reverse developing method. During this, the negatively charged toner particles move to the image portions, of which potential is higher than the developing bias, for the purpose of developing. At the same time, residual toner particles adhering to non-image portions of which potential is lower than the developing bias move to the surface of the developing roller 4*a* of which potential is at the developing bias, thereby cleaning the residual toner.

Then, as shown in FIG. 23(*b*), the toner on the photoreceptor 2*a* is transferred to a paper as a receiving medium. The distribution of toner left on the image portions of the photoreceptor 2*a* after the transfer is uniformed by the brash 29. The removal of charge during the writing process can be easily and efficiently conducted. In addition, residual toner particles are reliably moved to the developing roller 4*a*, thereby facilitating the cleaning.

Since the surface of the latent image carrier 2 is cleaned, thereby preventing the filming of the latent image carrier 2 and thus reducing image defects.

According to the image forming apparatus 1 of this example, residual developing powder 8' which is left on the latent image carrier 2 after the transfer is charged to have the same polarity as the original polarity thereof at the same time when the latent image carrier is uniformly charged by the charge control device 7, whereby the residual developing powder 8' on non-image portions of the latent image carrier 2 can be moved to the developing roller 4*a* during the developing by the developing device. That is, this apparatus can form an image in the cleaner-less cleaning method in which the developing of a latent image and the cleaning of the latent image carrier 2 can be simultaneously conducted.

As mentioned above, employment of the writing head 3 achieves reduction in size and simplification of the structure of the image forming apparatus 1 of this example. Particularly, since it is a cleaner-less image forming apparatus without a cleaning device, further simple structure can be achieved.

Because of employing the reverse developing, the residual developing powder 8' can be uniformed to have the same polarity of the developing powder 8 of the developing device 4, thereby further easily and effectively conducting the cleaning at the same time of developing.

Figure 24:
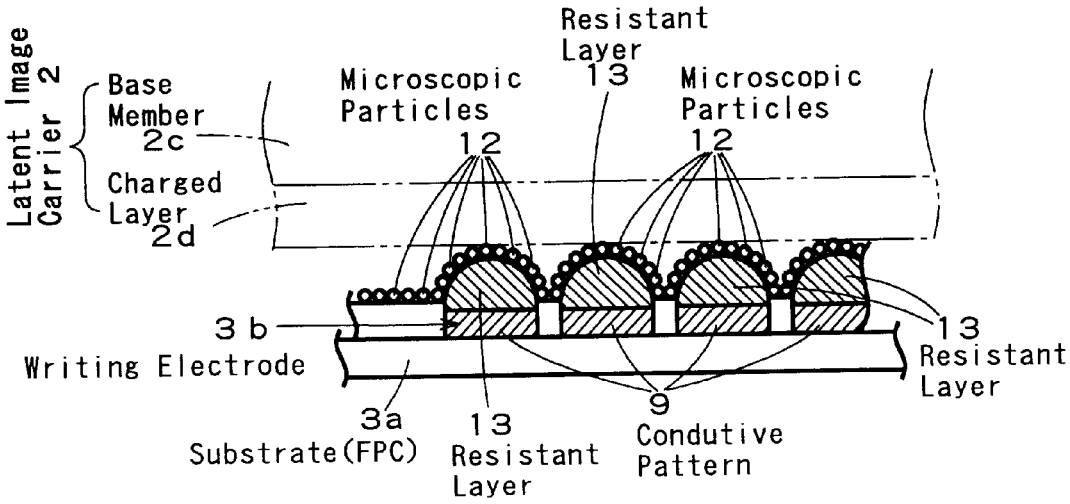
FIG. 24 is a view showing another embodiment of the present invention.

FIG. 24 is a view showing another embodiment of the present invention. In the drawings for the aforementioned examples, the writing electrodes 3*b* of the writing head 3 are illustrated with their contact portions to the latent image carrier 2 facing downward. In FIG. 24, however, the writing electrodes are illustrated with their contact portions to the latent image carrier 2 facing upward.

An image forming apparatus 1 of the example shown in FIG. 24 is different from the image forming apparatus 1 of the example shown in FIG. 21 by microscopic particles which are interposed between the writing head 3 and the latent image carrier 2.

In the writing head 3 of an example shown in FIG. 24, a resistant layer 13 having a rectangular section is formed on each electrode forming portion of the surface of the conductive pattern (Cu pattern) 9 formed on the substrate 3*a* so as to form each writing electrode 3*b* having a convexity of double layered structure. The resistant layer 13 can be formed by a conventional known coating method, for example by using an inkjet printer. Another known coating means may be employed instead of the inkjet printer. In case of using an inkjet printer, the thickness of the resistant layer 13 can be controlled with high precision, thereby achieving further accurate control of charge on the latent image carrier 2. When the resistance of the resistant layer 13 is relatively small, the application or removal of charge is dominated by the charge-transfer between the writing electrodes 3*b* and the latent image carrier 2. On the other hand, when the resistance of the resistant layer 13 is relatively large, the application or removal of charge is dominated by the discharge between the writing electrodes 3*b* and the latent image carrier 2.

In the writing electrode 3*b* of this example, the resistant layer 13 of the electrode 3*b* is formed substantially in a semi-circular convex shape projecting upwardly so that the top of the resistant layer 13 is a spherical surface. In addition, a large number of microscopic spherical particles 12 are arranged to be freely roll on or adhere to the substrate 3*a* and the entire surfaces of the writing electrodes 3*b* for the purpose of facilitating passing of foreign matters. The tops of the resistant layers 13 of the writing electrodes 3*b* touch the charged layer 2*d* of the latent image carrier 2 via the microscopic particles 12. That is, the writing electrodes 3*b* and the latent image carrier 2 are in non-contact state where they do not directly touch each other. In other words, the writing electrodes 3*b* are in proximity to the latent image carrier 2.

Foreign matters adhering to the surface of the latent image carrier 2 can easily pass not only because of the non-contact between the tops of the resistant layers 13 of the writing electrodes 3*b* and the latent image carrier 2 via the microscopic particles 12 but also with the aid of the microscopic particles 12 interposed therebetween. Therefore, filming of the surface of the latent image carrier 2 and also filming of the surfaces of the writing electrodes 3*b* can be effectively prevented.

Free rolling of the microscopic particles 12 reduces the friction between the writing electrodes 3*b* and the latent image carrier 2, leading to reduction in torque for rotating the latent image carrier 2.

The particle size of the microscopic particles 12 is normally set to have a diameter widely smaller than the particle diameter of developing powder. Because the particle diameter of toner is normally about 10 $\mu$m, the microscopic particles 12 are set to have a very small diameter of 1 $\mu$m or less. The microscopic particles 12 are made of transparent resin such as acrylic resin. Since the microscopic particles 12 are made of transparent resin, the microscopic particles 12 never affect the image portions even if the particles 12 move to the image portions of the latent image carrier 2.

Because of the non-contact between the writing electrodes 3*b* and the latent image carrier 2 via the microscopic particles 12, discharge occurs at and around the contact portions between the microscopic particles 12 and the latent image carrier 2. During this, the gap between the writing electrodes 3*b* and the latent image carrier 2 can be kept constant because of the existence of the microscopic particles 12, thus improving the discharge. The discharge applies charge to or remove charge from the charged layer 2*d* so as to write an electrostatic latent image on the latent image carrier 2. In this case, such portions, not subjected to the application or removal of charge, as mentioned above are not formed in the charged layer 2*d*.

When the microscopic particles 12 are supplied to both of the substrate 3*a* and the writing electrodes 3*b*, lubricity between the substrate 3*a*, the writing electrodes 3*b* and the latent image carrier 2 is improved.

The microscopic particles 12 may be supplied only to the writing electrodes 3*b* or other locations than the writing electrodes 3*b*. When the microscopic particles 12 are supplied only to the writing electrodes 3*b*, the gap between the writing electrodes 3*b* and the latent image carrier 2 can be kept constant because of the existence of the microscopic particles 12 so as to improve the discharge, just like the above case that the microscopic particles 12 are supplied to the both. When the microscopic particles 12 are supplied to other locations than the writing electrodes 3*b*, lubricity between the substrate 3*a* of the writing head 3 and the latent image carrier 2 is improved, just like the above case that the microscopic particles 12 are supplied to the both.

As a method of supplying (bonding) the microscopic particles 12 to at least one of the substrate 3*a* and the writing electrodes 3*b*, there is a method of supplying the microscopic particles 12 to the substrate 3*a* and/or writing electrodes 3*b* by providing a storage tank of microscopic particles 12 to the writing head 3 and gradually delivering the microscopic particles 12 from the storage tank through pores or brush slits. There is another method including: disposing an applying means such as a brush on a face of the writing head 3 confronting the latent image carrier 2, and applying the microscopic particles 12 to at least one of the substrate 2 and the writing electrodes 3*b* by using the applying means. There is still another method of previously applying the microscopic particles 12 onto at least one of the substrate 3*a* and the writing electrodes 3*b* by a brush or the like; and using the wring device previously applied with the microscopic particles 12.

The microscopic particles 12 may be supplied (or bonded) to the latent image carrier 2 other than the substrate 3*a* and the writing electrodes 3*b* of the writing head 3. As a method of supplying the microscopic particles 12 to the latent image carrier 2, there is a method of arranging a applying means such as a brush which is filled with the microscopic particles 12 at a position around the periphery of the latent image carrier 2; and applying the microscopic particles to the latent image carrier 2 by using the applying means. There is another method of previously applying the microscopic particles 12 to the entire peripheral surface of the latent image carrier 2 by using a brush or the like and using this latent image carrier 2 which is previously applied with the microscopic particles 12.

The charge of the microscopic particles 12 is selectively set to be charged to have the same polarity as the original polarity of the developing power 8 of the developing device 4. Therefore, the residual developing powder 8' on non-image portions of the latent image carrier 2 can be further effectively removed or collected. Interposing the microscopic particles 12 between the writing electrodes 3*b* and the latent image carrier 2 is extremely advantage for the structure of the image forming apparatus 1 without cleaning device, eliminating the necessity of the charge control device 7.

As apparent from the aforementioned description, in the image forming apparatus of the present invention, a convexity of each writing electrode is in contact with a latent image carrier so that the surface of the writing electrode is not entirely in contact with the latent image carrier, thereby allowing easy passing of foreign matters adhering to the surface of the latent image carrier and thus preventing the filming of the surface of the latent image carrier.

In addition, the writing electrodes are supported by a flexible substrate, thereby stabilizing the positions of the writing electrodes relative to the latent image carrier and thus stably and reliably conducting the application or removal of charge by the writing electrodes relative to the latent image carrier. Therefore, stable writing of an electrostatic latent image onto the latent image carrier is achieved, thus reliably obtaining a high quality image with high precision.

Since the writing electrodes can be securely kept in contact with the latent image carrier with a small pressing force by the flexible substrate, the gap (space) between the writing electrodes and the latent image carrier can be eliminated. No gap practically reduces the possibility that air existing in the gap is undesirably ionized, thereby further reducing the generation of ozone and enabling the formation of an electrostatic latent image with low potential. In addition, the latent image carrier can be prevented from being damaged by the writing electrodes, thus improving the durability of the latent image carrier.

Further, since the writing device employs only the writing electrodes without using a laser beam generating device or a LED light generating device which is large in size as conventionally used, the apparatus size can be reduced and the number of parts can also be reduced, thereby obtaining an image forming apparatus which is simple and low-price.

According to the present invention, since the convexity of the writing electrode is allowed to be formed in various configurations, the writing electrode is flexible to be employed in various types of image forming apparatus. In particular, when the convexity of the writing electrode is formed in a portion of sphere, a cone, an elliptic cone, an oval cone, a triangle pyramid, a square pyramid, or a polygonal pyramid having five corners or more, the writing electrode and the latent image carrier are in point contact, thereby further securely allowing foreign matters adhering to the surface of the latent image carrier to pass through. When the convexity of the writing electrode is formed in a circular column, a truncated cone, an elliptic column, a truncated elliptic cone, an oval column, a truncated oval cone, a triangle column, a truncated triangle pyramid, a square column of which cross section is a parallelogram or a trapezoid, a truncated square pyramid of which cross section is a parallelogram or a trapezoid, a polygonal column (having five corners or more), a polygonal pyramid (having five corners or more), and a truncated polygonal pyramid (having five corners or more), the writing electrode has side faces inclined against the feeding direction, whereby foreign matters adhering to the surface of the latent image carrier can easily pass through because the foreign matters easily slide along the inclined faces.

According to the present invention, at least the writing electrodes are coated with the protective layers. The protective layers prevent wear of the writing electrodes and prevent foreign matters from adhering to the writing electrodes.

According to the present invention, since the portion of the writing electrode confronting the latent image carrier is made of material easily to wear, the surface of the writing electrode should wear due to the contact relative to the latent image carrier so as to have a fresh surface so that the surface of the writing electrode can be kept fresh, thus preventing the filming of the writing electrode.

According to the present invention, residual developing powder which is left on the latent image carrier after the transfer is charged to have the same polarity as the original polarity of the developing powder before developing an electrostatic latent image, whereby the residual developing powder on non-image portions of the latent image carrier can be moved to a developing roller during the developing by a developing device. That is, this apparatus can form an image in the cleaner-less cleaning method in which the developing of a latent image and the cleaning of the latent image carrier can be simultaneously conducted.

According to the present invention, employment of the writing device achieves reduction in size and simplification of the structure of the image forming apparatus. In addition, since it is a cleaner-less image forming apparatus without a cleaning device, further simple structure can be achieved.

According to the present invention, a large number of microscopic particles are interposed at least between the writing electrodes and the latent image carrier. With the aid of the microscopic particles, foreign matters adhering to the surface of the latent image carrier can easily pass through, thus preventing the filming on the surface of the latent image carrier and on the surfaces of the writing electrodes. In addition, Free rolling of the microscopic particles 12 reduces the friction between the writing electrodes 3*b* and the latent image carrier 2, leading to reduction in torque for rotating the latent image carrier 2.

Since the charge of the microscopic particles is adapted to be charged to have the same polarity as the original polarity of the developing power, consisting of a single component, of the developing device, the residual developing powder on non-image portions of the latent image carrier can be further effectively removed or collected by the microscopic particles, placed on the non-image portions of the latent image carrier and charged as mentioned above. Interposing the microscopic particles between the writing electrodes and the latent image carrier enables to eliminate the necessity of the charge control device, thereby further simplifying the structure of the image forming apparatus without cleaning device.

According to the present invention, since residual developing powder which is left on the latent image carrier after the transfer is charged to have the same polarity as the original polarity thereof at the same time when the latent image carrier is uniformly charged, application of charge to the residual developing powder can be easily conducted.

According to the present invention, because of employing the reverse developing, the residual developing powder can be uniformed to have the same polarity of the developing powder during the process of uniformly charging the latent image carrier, thereby further easily and effectively conducting the cleaning at the same time of developing.

What we claim is:

1. An image forming apparatus comprising at least: a latent image carrier on which an electrostatic latent image is formed, a writing device for writing said electrostatic latent image on said latent image carrier, and a developing device for developing said electrostatic latent image on the latent image carrier, wherein said electrostatic latent image, written on said latent image carrier by said writing device, is developed by said developing device, thereby forming an image, said image forming apparatus being characterized in that writing electrodes of said writing device are in contact with a charged layer of said latent image carrier through microscopic particles interposed therebetween, thereby writing said electrostatic latent image.

2. An image forming apparatus as claimed in claim 1, being characterized in that the particle size of said microscopic particles is smaller than the particle size of developing powder supplied by said developing device.

3. An image forming apparatus as claimed in claim 1 or 2, being characterized in that said microscopic particles are made of transparent resin.

4. An image forming apparatus as claimed in claim 1, wherein said developing device is a developing device for developing said electrostatic latent image with developing powder consisting of a single component and a transferring device is provided for transferring a developing powder image on said latent image carrier, developed by said developing device, to a receiving medium, said image forming apparatus being characterized in that residual developing powder remaining on said latent image carrier after transfer is adapted to be charged to have the same polarity as the original polarity of said developing powder consisting of a single component at least before said electrostatic latent image is developed by said developing device.

5. An image forming apparatus as claimed in claim 4, being characterized in that said microscopic particles are interposed between said writing electrodes of said writing device and said latent image carrier to allow free rolling of said microscopic particles, wherein said microscopic particles are adapted to be charged to have the same polarity as the original polarity of said developing powder at least before said electrostatic latent image is developed by said developing device.

* * * * *